US005641299A

United States Patent [19]

Meguro et al.

[11] Patent Number: 5,641,299

[45] Date of Patent: Jun. 24, 1997

[54] CONNECTOR DEVICE AND AN ELECTRONIC APPARATUS WITH THE SAME

[75] Inventors: Hisao Meguro; Tetsuro Hirono; Minoru Tsujihara; Hiroshi Kawai, all of Kamakura, Japan

[73] Assignee: Mitsubishi Denki Kabushiki Kaisha, Tokyo, Japan

[21] Appl. No.: 411,960

[22] Filed: Mar. 28, 1995

[30] Foreign Application Priority Data

Mar. 31, 1994 [JP] Japan ..... 6-062264

[51] Int. Cl.[6] ..... H01R 4/50

[52] U.S. Cl. ..... 439/347; 439/953; 439/489

[58] Field of Search ..... 439/345, 953, 439/923, 152, 159, 158, 378, 258, 136, 155, 924.1, 911

[56] References Cited

U.S. PATENT DOCUMENTS

| | | | |
|---|---|---|---|
| 3,569,908 | 3/1971 | Appleton | 439/136 |
| 3,609,635 | 9/1971 | Harris . | |
| 4,157,855 | 6/1979 | Chan | 439/155 |
| 4,264,115 | 4/1981 | Chow . | |
| 4,671,597 | 6/1987 | Grill | 439/488 |
| 4,900,267 | 2/1990 | Nagasaka et al. . | |
| 4,980,800 | 12/1990 | Furuta | 439/953 |
| 5,114,359 | 5/1992 | Chishima et al. . | |
| 5,145,391 | 9/1992 | Alwine . | |
| 5,174,787 | 12/1992 | Shirai et al. . | |
| 5,186,639 | 2/1993 | Comerci et al. . | |
| 5,266,040 | 11/1993 | Merrill . | |
| 5,266,047 | 11/1993 | Black et al. . | |

FOREIGN PATENT DOCUMENTS

| | | |
|---|---|---|
| 0338105 | 4/1988 | European Pat. Off. . |
| 0300767 | 1/1989 | European Pat. Off. . |
| 0347294 | 12/1989 | European Pat. Off. . |
| 0416307 | 3/1991 | European Pat. Off. . |
| 0440330 | 8/1991 | European Pat. Off. . |
| 0621658 | 10/1994 | European Pat. Off. . |
| 2843247 | 4/1980 | Germany . |
| 3234738 | 3/1984 | Germany . |
| 59-136176 | 9/1984 | Japan . |
| 63-101472 | 7/1988 | Japan . |
| 63-279462 | 11/1988 | Japan . |
| 3-10357 | 1/1991 | Japan . |
| 1392573 | 4/1975 | United Kingdom . |
| 2174556 | 11/1986 | United Kingdom . |
| 2263204 | 7/1993 | United Kingdom . |
| WO94/16153 | 7/1994 | WIPO . |

*Primary Examiner*—P. Austin Bradley
*Assistant Examiner*—Yong Kim
*Attorney, Agent, or Firm*—Wolf, Greenfield & Sacks, P.C.

[57] ABSTRACT

For providing a connector device in which the combinational precision of a guide mechanism and a lock mechanism can be easily increased and it can be easily confirmed whether or not the engagement of the connector device and lock is effectively performed, a guide pin is provided to a male connector and a guide bore is provided to a female connector and they guide an engaging operation between the male connector and the female connector. The guide bore is provided therein with a retractable lock piece with a permanent magnet. An electromagnet provided at the lower portion of the lock piece is polar exchanged in response to a signal input from outside so that the lock piece is engaged with the guide pin or is disengaged from the guide pin to perform a lock/unlock operation. The position of the lock piece is detected to recognize the engaging or locking state of the connectors.

17 Claims, 16 Drawing Sheets

CONNECTOR DEVICE AND AN ELECTRONIC APPARATUS WITH THE SAME

BACKGROUND OF THE INVENTION

1. Field of the Invention

The present invention relates to a lock mechanism of a connector device employed in an electrical unit, for connecting signals.

2. Description of the Related Arts

As a recent development of information processing techniques, an information processing system is constructed in which a computer and a plurality of electrical units are connected to each other. In the system, many cable connector devices are used for transferring information to each of a plurality of information transfer media. In order to arrange many unified circuits in alignment in an electronic apparatus and thereby to simplify the maintenance, detachable units of a plug-in unit system are often used.

In such a processing system or electronic apparatus, the failure of a unit causes the operation inefficiency, data destruction, or the destruction of the whole system. In order to cope with such a state, there is employed a double structure of units in which two identical units are prepared and one of the units automatically starts operating to make it possible for the processing system to continuously operate when the other is failed. In this duplicated structure, there is an advantage In that a unit can be replaced while the system is still in operation so that the maintenance can be performed without decreasing the operation efficiency. On the other hand, there is a problem in that because a unit can be replaced at any time during the system operation, a normally operating unit may be erroneously pulled out from the processing system. In this case, the destruction of data or the system would be caused.

In order to solve the above problems, a connector device in which a lock mechanism is provided for preventing a unit from being erroneously pulled out and a faulty unit can be pulled out only after a control signal is supplied from a host processing system, is disclosed in, for example, JP-A-63-279462. That is, in this apparatus, when recognizing the faulty unit, the processing system switches from the faulty unit to another unit and at the same time unlocks the lock of the faulty unit to enable the faulty unit to be removed for repair.

In a case where the connector device having the above lock mechanism is used for a plug-in unit, the configuration as shown in FIG. 1 would be considered. As shown in FIG. 1, a back panel 200 has a female connector 201 at both ends of which guide pins 202 are provided for guiding the female connector 201 when it is to be engaged with a male connector to be described later. On the other hand, a plug-in unit 203 accommodates a magnetic disk apparatus 204 therein. The male connector 206 mounted on a printed circuit board 208 is provided to a case 205 of the plug-in unit 203 and connected to the magnetic disk apparatus by a cable 209. In addition, guide bores 207 which engage with the guide pins 202, respectively, are arranged in the case 205. Further, an electromagnetic solenoid 201 with a retractable plunger 211 is arranged in the plug-in unit 203. The engagement hole 213 engaging with the plunger 211 is punched in a rail 212 for supporting the plug-in unit 203 mounted on the back panel 200.

The procedure of engagement in the connector device thus configured as described above will be described below.

First, when being installed in the back panel 200, the plug-in unit 203 is guided in accordance with grooves provided on the rail 212 so as to be positioned at a desired position. Then, the guide pins 202 each having tapered tip ends engage with the guide bores 207 in accordance with the guide of the tapers so that the female connector 206 engages with the male connector 201. The plunger 211 of the electromagnetic solenoid 210 of the plug-in unit 203 is accommodated in the case 205 when no power is supplied. However, after the male connector 206 has engaged with the female connector 201, the plunger 211 is inserted into the engagement hole 213 of the rail 212 by activating the electromagnetic solenoid 210 in response to a control signal supplied from the host processing system (not shown) to lock the plug-in unit 203.

Further, the plug-in unit 203 is fixed to the rail 212 by a fixing screw 214. Thus, the plug-in unit 203 is completely installed. Thereafter, the magnetic disk apparatus 204 is supplied with power and set in an operable state.

Next, in a case where the plug-in unit 203 needs to be pulled out for any reason, such as failure or system modification, the magnetic disk apparatus 204 and other processing circuits need to be stopped for reasons such as prevention of data destruction in the magnetic disk apparatus 204 and prevention of damage of the plug-in unit 203 or the processing system. For these reasons, in the plug-in unit 203 of this example, the measures taken to stop operation, such as rotation, are, for example, disconnecting the power supply before the plug-in unit 203 is pulled out and after a predetermined time is elapsed, which is the time required for the rotation to stop, the power supply is disconnected in response to the control signal supplied from the host processing system which draws the plunger 211 of the electromagnetic solenoid 210 from the engagement hole 213 on the rail 212. Thereafter, the fixing screw 214 is loosened and the plug-in unit 203 is pulled out from the back panel 200.

Therefore, only one of the plug-in units designated by the control signal supplied from the host processing system is allowed to be pulled out and erroneous operation, such as pulling out of a normally operating unit, is prevented. As a result of this, data destruction and system destruction can be avoided.

However, since the conventional connector device is configured as described above, the positioning precision for the guide bore and the guide pin as a guide mechanism directing the connector engagement, and the positioning precision for the engagement hole and the plunger of the electromagnetic solenoid of the lock mechanism for maintaining the connector engagement are both required at the same time. That is, in addition to the precision of parts required in the design, the assembly precision is also required when the parts are assembled. Both the positioning precision and the assembly precision over a plurality of connector devices, i.e., a combinational precision, must be maintained because the plug-in unit needs to be replaced when an internal part has failed or the magnetic disk apparatus is to be exchanged with a new one. In a case that these precisions cannot be maintained, a problem is caused in that the engagement of the plunger cannot be performed smoothly, the lock cannot function effectively, or the extraction and insertion of a connector cannot be performed smoothly. Also, there is another problem in that inadequate installation of a plug-in unit and erroneous extraction of a plug-in unit cannot be completely prevented because it cannot be confirmed whether or not the engagement of the connector device or lock is reliably performed. Further, there is still another problem in that a large amount of processing time is required to maintain the combinational precision as described above.

SUMMARY OF THE INVENTION

The present invention has, as an object, to provide a connector device in which a connector can be inserted and extracted smoothly by easily increasing the combinational precision of a guide mechanism and a lock mechanism. In addition to this, the present invention has, as another object, to provide a connector device in which the combinational precision of a guide mechanism and a lock mechanism can be maintained even when the connector device is replaced by another connector device. Further, the present invention has, as a further object, to provide a connector device having high reliability in which there is provided a lock mechanism in which it can be easily confirmed whether or not the engagement of the connector device and locking is effectively performed.

In one embodiment, a connector device of the present invention which includes a pair of connector housings engageable with each other and accommodating signal connecting terminals for signal transfer, is characterized by including lock/unlock means operating in response to a signal input externally into the inside of the housings, for maintaining or unlocking the engagement between the connector housings.

The lock/unlock means provided in the connector housings, performs a lock/unlock operation in response to an externally input signal to the housings, and maintains or unlocks the engagement between the connector housings. Therefore, careless extraction of the connector can be prevented. Also, the connector device having high reliability can be obtained. Further, it is made possible to determine positioning precision of the lock/unlock means upon the assembly of the connector housings. Thus, the combinational precision of each of the connector devices needs not be adjusted even when among a plurality of connector devices, one connector device Is replaced by another connector device, so that the connector device having good useability can be obtained.

In another embodiment, the present invention is characterized in that the lock/unlock means is operated based on an electric signal to maintain or unlock the engagement between the connector housings.

The lock/unlock means provided in the connector housing performs the lock/unlock operation based on an externally input electrical signal to maintain or unlock the engagement between the connector housings. Therefore, the connector device having high reliability can be obtained.

In another embodiment, the present invention is characterized by further including guide means having a guide pin provided for one of the connector housings and a guide bore provided for the other of the connector housings, for guiding an engaging operation, in that the lock/unlock means has at least one retractable lock piece provided in the guide bore, and in that the guide means is locked by engaging the lock piece with the side of the guide pin.

Therefore, the engaging operation is guided by the guide means when the pair of connector housings are engaged with each other and at least one retractable lock piece is provided in the guide bore, and the guide means is locked by engaging the lock piece with the side of the guide pin inserted in the guide bore by an advancing and retracting operation of the lock piece. That is, because there is achieved the structure for the lock/unlock operation of the connector device using a part of the guide means which is incorporated into the connector device, the down sizing of the connector device can be realized with low cost. Also, because the lock/unlock means can be assembled within the assembly of the guide means, the assembly error can be eliminated, resulting In easy assembly with high precision.

Further, in another embodiment, the present invention is characterized in that the guide pin or the guide bore is formed as a unit with a fixing member for fixing the connector housing to a fixed portion. Therefore, the down sizing of the connector device can be realized with low cost.

Further, in yet another embodiment, the present invention is characterized in that the lock/unlock means of the connector device includes a polar exchangeable electromagnet and a permanent magnet which is attracted or repulsed to the electromagnet, and in that the lock piece includes either the electromagnet or the permanent magnet and advances or retracts with the polar exchange of the electromagnet.

Therefore, the lock piece is attracted or repulsed by the electromagnet as a result of the polar exchange of the electromagnet to perform the lock/unlock operation of the guide pin and the lock piece. Therefore, the power supply is required only when the lock piece is to be moved and after the completion of the lock/unlock operation, the locking state or unlocking state can be maintain without the power supply. As a result, the power consumption of the connector device can be reduced and the connector device can be down sized and simplified.

Further, in another embodiment, the present invention is characterized in that a contact portion with which the lock piece contacts in the locking state and/or the unlocking state is made of metal or a magnetic substance which can attract and hold the lock piece.

Therefore, because the lock piece can be attracted and held to the magnetic substance or metal at the advanced position or the retracted position in the advancing/retracting operation, the locking state or unlocking state can be maintained without the externally supplied power after the completion of the lock/unlock operation. As a result, the power consumption of the connector device can be reduced and the connector device can be down sized and simplified.

Further, in yet another embodiment, the present invention is characterized that the lock piece and the guide pin both have contact surfaces which fit closely together.

Therefore, the lock piece can be attracted to the guide pin made of the magnetic substance or metal as the contact section by the electromagnet or permanent magnet incorporated into the lock piece such that they can be rigidly contacted with each other. As a result, the connector device can be obtained in which the lock operation can be performed with high reliability.

Further, in another embodiment, the present invention is characterized by further comprising a light guide path provided to one of the pair of engageable connector housings, for guiding incident light from the outside, and photo-electric converter means provided to the other of the pair of connector housings, for receiving the light guided by the light guide path to convert it into electrical energy upon the engagement between the connector housings, and in that the electromagnet of the lock/unlock means is driven to advance or retract the lock piece by the electrical energy generated during the engagement between the connector housings.

That is, the light incident from the outside and guided by the light guide path is received and converted into the electric energy by the photo-electric converter means. Then, the electromagnet of the lock/unlock means is driven to advance or retract the lock piece by the electric energy generated during the engagement between the connector housings. Therefore, the connector device can be obtained which is hardly influenced by external noise. In addition, because light energy is converted into the electrical energy by the photo-electric converter means only when the engagement is performed normally, it functions as engagement state detecting means. Thus, the connector device having high reliability can be obtained.

Further, in a further embodiment, the present invention is characterized in that the lock/unlock means of the connector device includes a transfer connection terminal for transferring a control signal to operate the lock/unlock means, and in that the transfer connection terminal is connected to the signal connection terminal incorporated in the connector housing to perform signal transfer to/from the external.

Therefore, a new connection terminal need not be provided for transferring the control signal and the connector device can be down sized with low cost.

Further, this embodiment is further characterized in that the lock/unlock means has a detachable structure independent upon the connector housings. Therefore, it is possible to perform the replacement and modification of the lock/unlock means and the connector device can be obtained with good useability.

In yet another embodiment, the present invention which includes a pair of connector housings engageable with each other and accommodating signal connecting terminals for signal transfer, is characterized by including lock/unlock means operating in response to a signal externally input into the housings, for maintaining or unlocking the engagement between the connector housings, and engaging state detecting means for detecting the engaging state of the connector housings to output a detection signal. That is, because the engaging state detecting means detects the engaging state of the connector housings and outputs a detection signal, the lock operation between the male and female connectors is performed in accordance with the detection signal. Therefore, an error lock operation can be reliably prevented in which the male and female connectors are engaged erroneously, and the connector device with high reliability can be obtained.

In still another embodiment, the present invention is characterized in that the engaging state detecting means detects the engaging state based on the conductive state of an electrical signal between electrodes respectively provided to the connector housings.

That is, because the engaging state detecting means detects the engaging state based on the conductive state of an electrical signal between electrodes respectively provided to the connector housings to output the detection signal, an error lock operation can be reliably prevented in which the male and female connectors are engaged erroneously, and the connector device with high reliability can be obtained.

Further, in another embodiment, the present invention is characterized in that the engaging state detecting means includes a transfer connection terminal for transferring a detection signal, and in that the transfer connection terminal is connected to the signal connection terminal incorporated in the connector housing to transfer the detection signal externally.

Therefore, a new connection terminal need not be provided for transferring the control signal, and the connector device can be down sized with low cost.

Further, the present invention is characterized in that the engaging state detecting means detects the engaging state based on the transmitting state of a light path formed between a light emitting section provided to one of the pair of connector housings and a light receiving section provided to the other of the pair of connector housings. Therefore, an error lock operation can be reliably prevented in which the male and female connectors are engaged erroneously, and the engaging state detection structure can be obtained with high reliability and strong electrical noise resistance.

Further, in a still further embodiment, the present invention, which includes a pair of connector housings engageable with each other and accommodating signal connecting terminals for signal transfer, is characterized by including lock/unlock means operating in response to an externally input signal to the inside of the housings, for maintaining or unlocking the engagement between the connector housings, and locking state detecting means for detecting the locking state of the lock/unlock means to output a detection signal. That is, because the locking state detecting means detects the locking state of the connector housings to output a detection signal, an error lock operation can be reliably prevented in which the male and female connectors are engaged erroneously, and the connector device with high reliability can be obtained.

Further, in another embodiment, the present invention is characterized by further including guide means having a guide pin provided for one of the connector housings and a guide bore provided for the other of the connector housings, for guiding an engaging operation, in that the lock/unlock means has at least one retractable lock piece provided in the guide bore, and in that the locking state detecting means performs the lock detection based on the conductive state of an electrical signal between electrodes respectively provided to the lock piece and one of the connector housing. Therefore, an error lock operation can be reliably prevented in which the male and female connectors are engaged erroneously, and the connector device with high reliability can be obtained.

Further, still another embodiment, the present invention is characterized by further including guide means having a guide pin provided for one of the connector housings and a guide bore provided for the other of the connector housings, for guiding an engaging operation, in that the lock/unlock means has at least one retractable lock piece provided in the guide bore, and in that the locking state detecting means performs the lock detection based on the conductive state of an electrical signal between electrodes respectively provided to the lock piece and the guide pin. Therefore, an error lock operation can be reliably prevented in which the male and female connectors are engaged erroneously and the connector device with high reliability can be obtained.

Further, in another embodiment, the present invention is characterized by further including guide means having a guide pin provided for one of the connector housings and a guide bore provided for the other of the connector housings, for guiding an engaging operation, in that the lock/unlock means has at least one retractable lock piece provided in the guide bore, and in that the locking state detecting means detects the locking state based on the transmitting state of a light path formed between a light emitting section and a light receiving section provided to the proceeding and retracting section of the lock piece. Therefore, an error lock operation can be reliably prevented in which the male and female connectors are engaged erroneously, and the locking state detection structure can be obtained with high reliability and strong electric noise resistance.

Further, a still further embodiment, the present invention is characterized by further including guide means having a guide pin provided for one of the connector housings and a guide bore provided for the other of the connector housings, for guiding an engaging operation, in that the lock/unlock means has at least one retractable lock piece provided in the guide bore, and in that the locking state detecting means includes a relay of magnetic field sensing type provided in the guide pin, and a magnetic substance provided in the lock piece, and in that the locking state detecting means detects the locking state by driving the magnetic field sensing type relay operating based on the change in the magnetic field generated from the proceeding and retracting operation of the lock piece. Therefore, erroneous detection due to external noise and contact faults of external terminals can be reliably prevented, and the connector device can be obtained with high reliability.

Further, in this embodiment, the present invention, which includes a pair of connector housings engageable with each other and accommodating signal connecting terminals for signal transfer, is characterized by including lock/unlock means operating in response to a signal externally input into the inside of the housings, for maintaining or unlocking the engagement between the connector housings, and guide means for guiding an engaging operation, and having a guide pin and a guide bore, said guide pind and guide bore being provided for each of the other of the connector housings, and in that the lock/unlock means is provided independently of the guide means. Therefore, it is possible to perform the replacement and modification of the lock/unlock means and the connector device can be obtained with good useability.

Further, in yet another embodiment, the present invention is characterized in that the lock/unlock means includes a movable lock piece moving based on the change in the shape of a heat deformable member changing in accordance with temperature change and provided on one of the pair of connector housings, heating means for heating the heat deformable member, and an engaging section provided on the other of the pair of connector housings, to which engaging section the movable lock piece is engaged.

That is, the heat deformable member is heated by the heating means so that the movable lock piece is moved. As a result, the engaging section provided on the other of the pair of connector housings engages with the movable lock piece. Therefore, the connector device can be obtained with a reliable lock mechanism by a simple structure and a simple control.

Further, in a still further embodiment, the present invention is characterized by further comprising a light guide path provided on one of the pair of engageable connector housings, for guiding incident light from the outside, and photo-electric converter means provided on the other of the pair of connector housings, for receiving the light guided by the light guide path to convert it into electrical energy, and in that the heating means is driven by the electric energy generated upon the engagement between the connector housings to heat the heat deformable member so that the movable lock piece provided to one of the pair of connector housings engages with the engaging section provided on the other of the pair of connector housings.

That is, the light incident from the outside and guided by the light guide path is received and converted into the electrical energy by the photo-electric converter means. Then, the heating means is driven by the electrical energy generated by the photo-electric converter means upon the engagement between the connector housings to heat the heat deformable member so that the movable lock piece provided to one of the pair of connector housings engages with the engaging section provided to the other of the pair of connector housings. Therefore, the connector device can be obtained which is hardly influenced by external noise. In addition, because light energy is converted into electrical energy by the photo-electric converter means only when the engagement is performed normally, it functions as engagement state detecting means. Thus, the connector device having high reliability can be obtained.

Further, in yet another embodiment, an electronic apparatus of the present invention which comprises a connector device including a pair of connector housings engageable with each other and accommodating signal connecting terminals for signal transfer, is characterized by including lock/unlock means operating in response to a signal externally input into the inside of at least one of the connector housings, for maintaining or unlocking the engagement between the connector housings.

Therefore, careless extraction of the connector device from the electronic apparatus can be prevented. Further, it is made possible to determine positioning precision of the lock/unlock means upon the assembly of the connector housings. Thus, a combinational precision of each of the connector devices does not need to be adjusted even when among a plurality of connector devices, one connector device is replaced by another connector device, so that a system including the connector device having good useability can be constructed.

DESCRIPTION OF THE PREFERRED EMBODIMENTS

FIRST EMBODIMENT

The first embodiment of the present invention will be described below with reference to the accompanying drawings.

Figure 1:
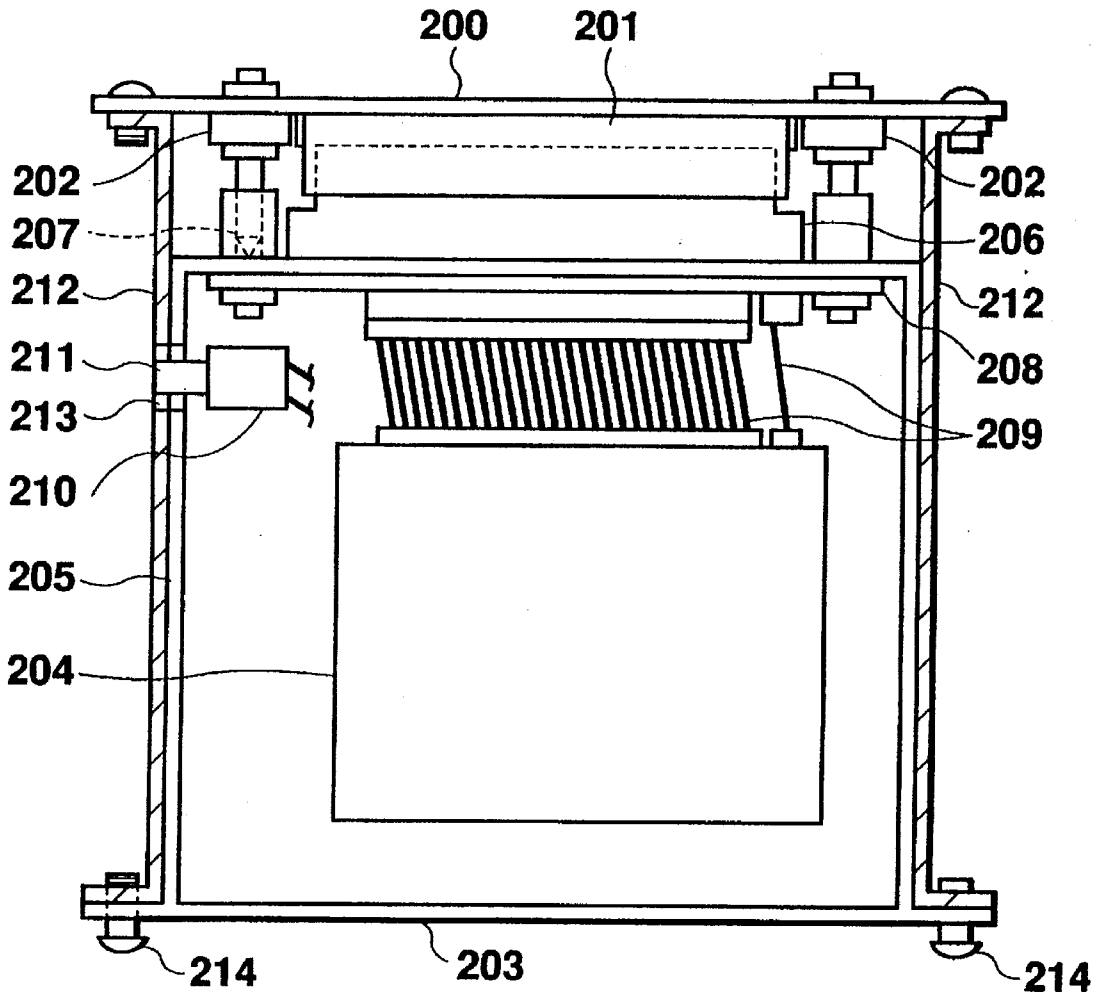
Fig. 1 (PRIOR ART)
FIG. 1 is a plan view of a conventional connector device.
Figure 2:
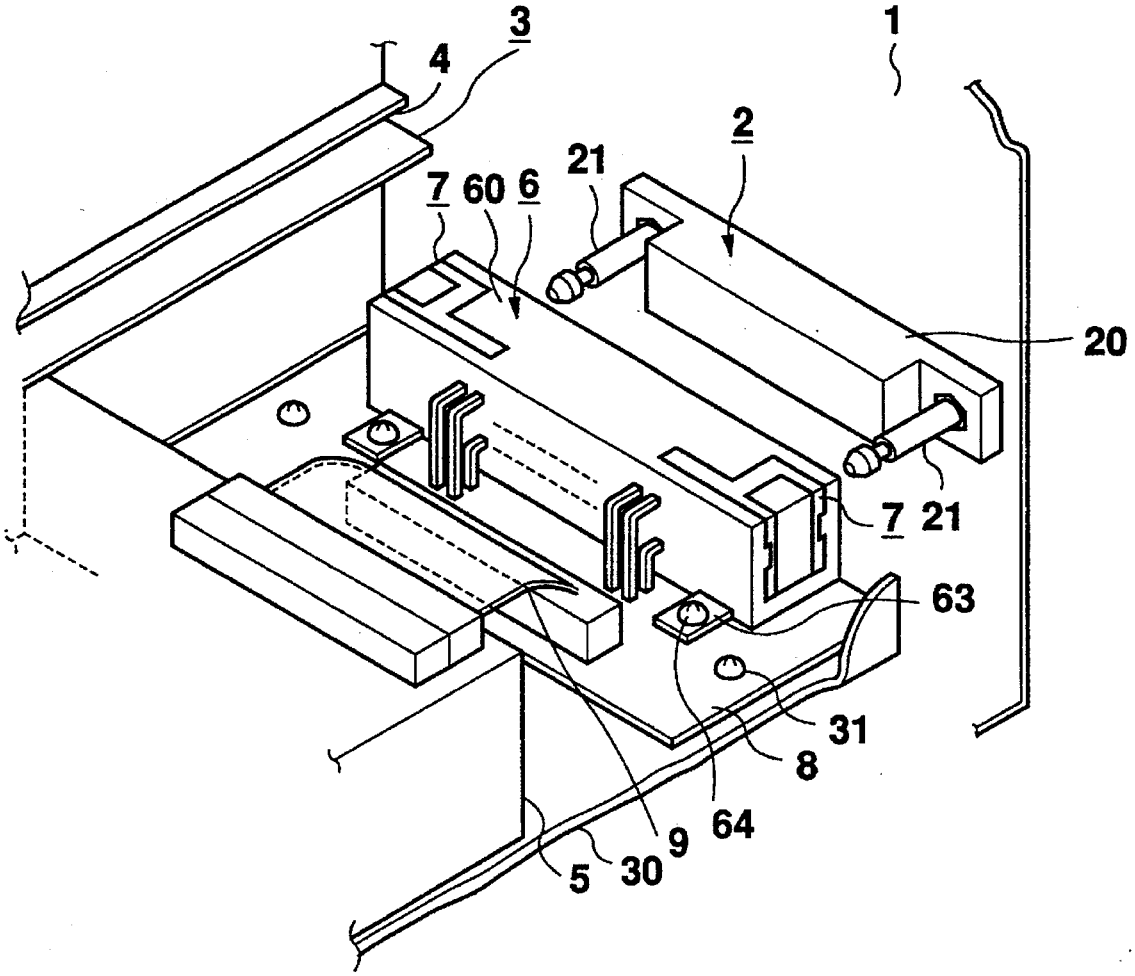
FIG. 2 is a perspective view of a connector device according to a first embodiment of the present invention.
Figure 3:
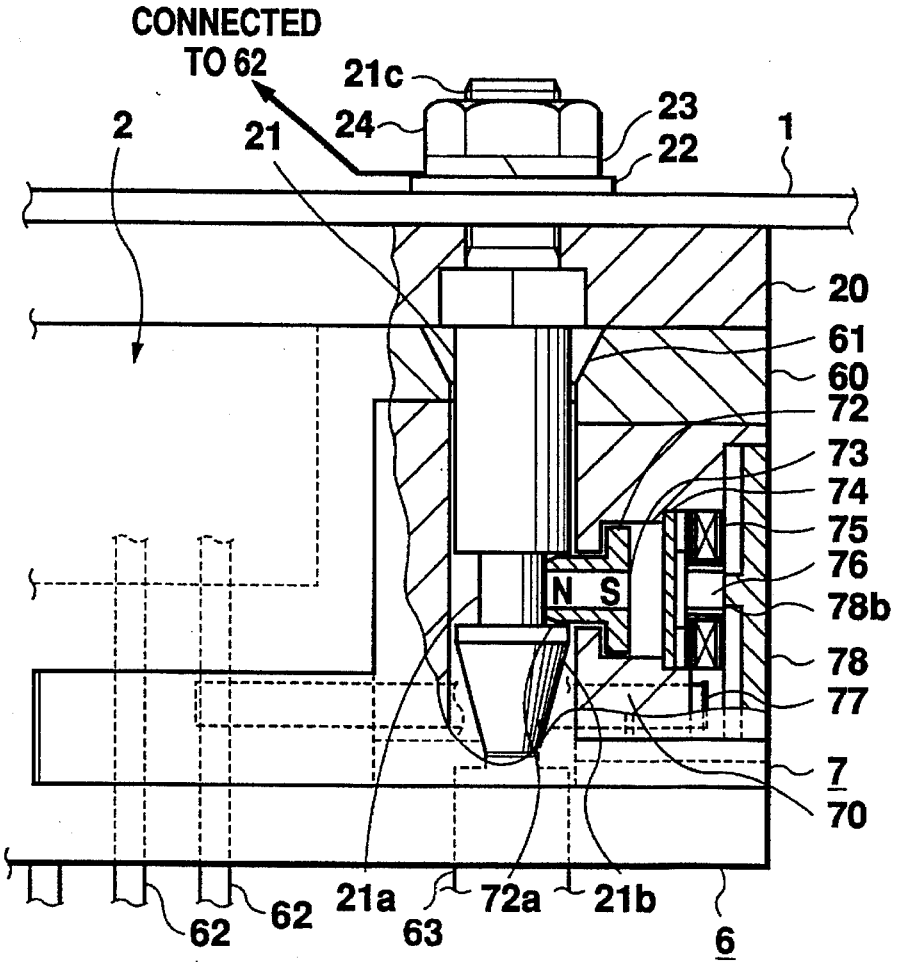
FIG. 3 is a top plan view of a lock mechanism unit and the periphery according to the first embodiment of the present invention.
Figure 4:
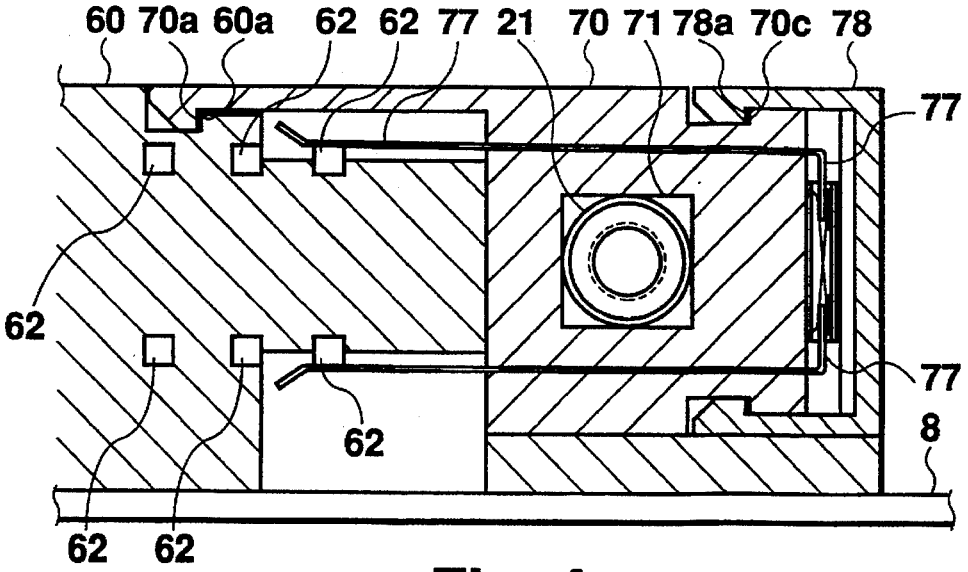
FIG. 4 is a front plan view of the lock mechanism unit and periphery according to the first embodiment of the present invention.
Figure 5:
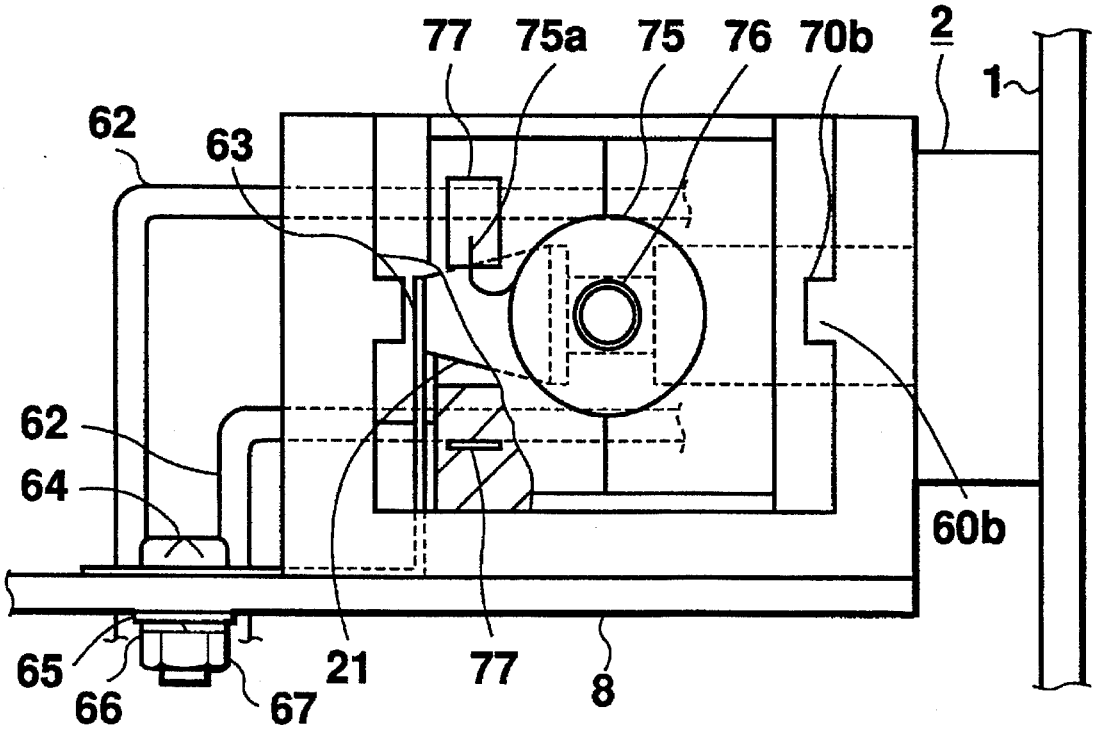
FIG. 5 is a side plan view of the lock mechanism unit and the periphery (in a state in which a cover is removed) according to the first embodiment of the present invention.

FIG. 2 is a perspective view of an apparatus on which a plug-in unit is mounted according to the first embodiment of the present invention, FIG. 3 is a top plan view of a lock mechanism unit as lock/unlock means of a connector device according to the first embodiment of the present invention, FIG. 4 is a front plan view of the lock mechanism unit, and FIG. 5 is a side plan view of the lock mechanism unit.

In FIG. 2, a male connector 2 fixed to a back panel 1 has a pair of guide pins 21 made of iron or magnetic material and respectively provided at the ends of the connector 2. As shown in FIG. 3, each of the guide pins 21 has at the tip a tapered section 21*b* which is followed by a thin groove section 21*a*. At the opposite end of the pin to the groove section 21*a*, the guide pin 21 is provided with a screw section 21*c*. The guide pin 21 is fixed to the back panel 1, together with the male connector 2, by a flat washer 22, a spring washer 23 and a nut 24 on the rear side of the back panel 1. Therefore, the guide pin 21 can be positioned accurately and the number of parts can be reduced, resulting in the down sizing of the connector device and the achievement of low cost.

On the other hand, a plug-in unit 3 covered by a case 30 is inserted along guide sections 4 provided in the chassis so that the male connector 2 is engaged with a female connector 6 to be referred to later. There are incorporated in the plug-in unit 3 a magnetic disk apparatus 5 and the female connector 6 mounted on a printed circuit board 8. The magnetic disk apparatus 5 is connected to the printed circuit board 8 by a cable 9.

The feature of the present invention lies in that there is provided a lock mechanism unit as lock/unlock means for maintaining or holding the engaging state between the male connector 2 and the female connector 6 and unlocking the female connector 6 from the male connector 2. That is, the guide pins 21 protruded from the housing 20 of the male connector 2 are inserted into guide bores 61 of the lock mechanism unit 7 which are provided at both sides of the housing 60 of the female connector 6. A lock piece 72 is provided on the side surface of the guide bore 61 in a retractable manner in a radius direction of the bore 61. The lock piece 72 contains a permanent magnet 73 and has a tapered section 72*a* at the tip and is made of iron or magnetic material. Following the tip (on the right hand side in FIG. 3), an iron piece 74 is provided which is in turn followed by an electromagnet composed of a coil 75 and an iron core 76. A lead wire 75*a* of the coil 75 is connected via a contact lead (a transfer contact terminal) 77 to a connector pin (a signal connection terminal) 62 incorporated in the female connector 6, for transferring a signal from/to control units (see FIGS. 4 and 5).

As described above, the lock mechanism unit 7 is fitted to the female connector 6 while it is guided by the guide section 60*b* of the female connector 6. Then, a lock claw section 70*a* provided on the housing 70 of the lock mechanism unit 7 engages with the groove section 60*a* of the housing 60. Thus, the lock mechanism unit 7 is fixed. Further, there is provided on the housing 70 a cover 78 having a coil pressing section 78*b* for pressing the coil 75 of the electromagnet. A lock claw section 78*a* of the cover 78 engages with a groove section 70*c* of the housing 70. Thus, the cover 78 is also fixed. Therefore, the lock mechanism unit 7 can be easily mounted or demounted and the lock/unlock means can be easily replaced and modified, resulting in the connector device having good useability.

A contact lead 63 is provided at the bottom of the guide bore 61, i.e., at the portion of the bore which the tip of the guide pin contacts when the guide pin 21 is inserted into the guide bore 61. The contact lead 63 is fixed to the printed circuit board 8 by a screw 64, a flat washer 65, a spring washer 66, and a nut 67.

Next, the engagement and locking of the connector device according to the embodiment of the present invention will be described below.

The male connector 2 is fixed to the back panel 1 by the nut 24 and the screw section 21*c* provided to the guide pin and the guide pin 21 is connected to a signal line on the back panel 1. The magnetic disk apparatus 5, the printed circuit board 8 for the female connector 6 to be mounted, and the cable 9 for connecting between the magnetic disk apparatus 5 and the printed circuit board 8 are incorporated into the plug-in unit 3. The female connector 6 is fixed to the printed circuit board 8 by the contact lead 63 incorporated into the housing. The contact lead 63 is connected to a signal line on the printed circuit board.

The lock mechanism unit 7 is positioned by the guide section 60*b* of the connector housing and the guide groove section 70*b* of the lock mechanism unit 7 and is incorporated into the female connector 6 in such a state. In this state, a contact lead 77 of the lock mechanism unit 7 is electrically connected to each of a plurality of connector pins 62. As described above, the lock mechanism unit 7 includes in the housing 70, a lock piece 72 of which the electromagnet 73 is incorporated, an iron piece 74 for holding the lock piece 72, the coil 75 of the electromagnet and the iron core 76 of the electromagnet. A lead wire 75*a* of the coil 75 of the electromagnet is connected to the contact lead 77 and the cover 78 fixes the whole of the electromagnet.

The plug-in unit 3 is guided by the guide section 4 provided on the chassis such that the male connector 2 mounted on the back panel 1 and the female connector 6 incorporated in the plug-in unit 3 can be positioned within a predetermined precision. When the plug-in unit 3 is inserted to a predetermined position, both the connectors 2 and 6 are positioned by the guide pins 21 incorporated into the male connector 2 and the guide bores 61 provided on the female connector 6. By further inserting the plug-in unit 3, the male connector 2 and the female connector 6 are engaged with each other.

At the time when the plug-in unit 3 is installed, the lock piece 72 is attracted to the iron piece 74 by the magnetic force of the permanent magnet 73. Even if the lock piece 72 is not attracted to the iron piece 74, the lock piece 72 is moved by the tapered section 21*b* of the guide pin 21 and the tapered section 72*a* of the lock piece 72 to a position where the lock piece 72 does not prevent the insertion of the guide pin 21.

When the male connector 2 engages with the female connector 6 in a normal state, the guide pin 21 of the male connector 2 contacts the contact lead 63 of the female connector 6. As a result of this, the conductive state is established between the signal line connected to the guide pin 21 and the signal line connected to the contact lead 63. Therefore, it is made possible to electrically confirm that the male connector 2 engages with the female connector 6 in a normal state, and the thereby that the plug-in unit 3 is installed in the back panel 1 in a normal state, which functions as engaging state detecting means. It should be noted that the conductive state of the engaging state detecting means is output to a host apparatus such as a processing system connected using a relay (not shown). When a detection signal indicating that the plug-in unit 3 is normally connected to the back panel 1 (the male connector 2 is engaged with the female connector 6) is output from the engaging state detecting means, a current flows from the host apparatus to the coil 75 of the electromagnet via the connector pin 62 and the contact lead 77 such that a magnetic field having the same polarity as that on the side of the iron piece 74 of the magnetic field generated by the permanent magnet 73 of the lock piece 72 (the polarity S in a case shown in FIG. 3) is generated in the iron piece on the side of the lock piece 72. As a result, the lock piece 72 and the iron piece 74 are repulsed from each other. The lock piece 72 is moved and attracted to the groove section 21*a* of the guide pin made of iron or magnetic material. As a result, the guide pin 21 cannot be pulled out from the female connector 6.

When the plug-in unit 3 is pulled out from the back panel 1, the current flows in the direction opposite to the above direction. As a result, the lock piece 72 of the permanent magnet 73 and the iron piece 74 are attracted to each other so that the lock piece 72 is attracted to the iron piece 74 to unlock the locking state between the lock piece 72 and the guide pin 21. In this manner, the lock piece 72 in which the permanent magnet 73 is buried is maintained in the state in which the lock piece 72 is attracted to either the guide pin 21 or the iron piece 74. Therefore, the supply of power is required only for a predetermined period of time. In order to maintain the locking state or the unlocking state, no power is required, resulting in power saving and down sizing and simplification of the connector device.

It should be noted that although the magnetic disk apparatus is mounted in the plug-in unit in the above embodiment, a printed circuit board or a storage apparatus such as a flexible disk apparatus and a tape apparatus may be mounted in the plug-in unit. Further, the material of the guide pin is a magnetic material in the above embodiment. However, only a portion of the guide pin to which the lock piece is attracted may be made of magnetic material. Therefore, the reduction of the part cost can be achieved by employing resin for the other portion of the guide pin. Further, in the above embodiment, the male connector is mounted on the back panel and the female connector is mounted in the plug-in unit. However, the male connector may be mounted in the plug-in unit and the female connector may be mounted on the back panel. Further, in the above embodiment, the polarity N of the permanent magnet is provided on the side of the guide pin. However, the polarity S of the permanent magnet may be provided on the side of the guide pin. Furthermore, in the above embodiment, a single lock piece is retractably provided on guide pin. However, a plurality of lock pieces may be provided around the guide pin. For instance, two lock pieces may be provided on both sides of the guide pin in FIG. 3. Thus, a rigid locking state can be achieved.

SECOND EMBODIMENT

Figure 6:
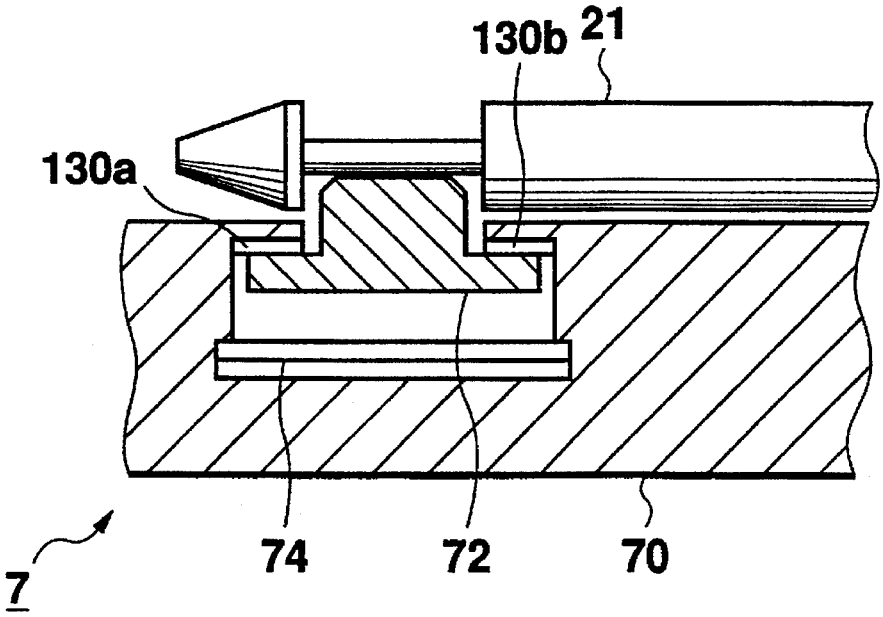
FIG. 6 is a cross sectional view of a lock mechanism according to a second embodiment of the present invention.

FIG. 6 is a schematic diagram showing another locking method of the lock mechanism unit according to the first embodiment of the present invention. In FIG. 6, the same components as those in FIG. 3 are assigned with the same reference numerals and the description will be omitted.

The feature of the present embodiment is that the lock piece is held on the side of the housing of the lock mechanism unit when the lock piece is engaged with the guide pin. That is, there iron pieces 130*a* and 130*b* are arranged on the inside of the housing 70 of the lock mechanism unit 7 at a contact section to which the lock piece 72 contacts when the lock piece 72 locks the guide pin 21. By providing the iron pieces 130*a* and 130*b* in the housing 70 at the contact section contacting the lock piece 72, when lock is to be performed, for instance, the lock piece 72 is repulsed from the iron piece 74 such that the lock piece 72 is attracted to the iron piece 130 provided in the housing 70 by changing the polarity of the electromagnet, as described in the first embodiment. Thus, the guide pin 21 cannot be pulled out from the connector 6. When the lock is to be unlocked, the lock piece 72 is caused to be attracted to the iron piece 74 by changing the polarity of the electromagnet. In this case, the attraction force of the electromagnet needs to be greater than the attraction force when the permanent magnet 73 incorporated in the lock piece 72 is attracted to the iron piece 130.

As in the second embodiment, by holding the lock piece on the side of the housing of the lock mechanism unit, the guide pin 21 can be made of material such as, for example, resin other than metal and magnetic material, resulting in cost reduction of the part. However, in this case, detecting means such as electrodes for detecting whether the male connector 2 is normally engaged with the female connector 6 needs to be separately provided.

THIRD EMBODIMENT

Figure 7:
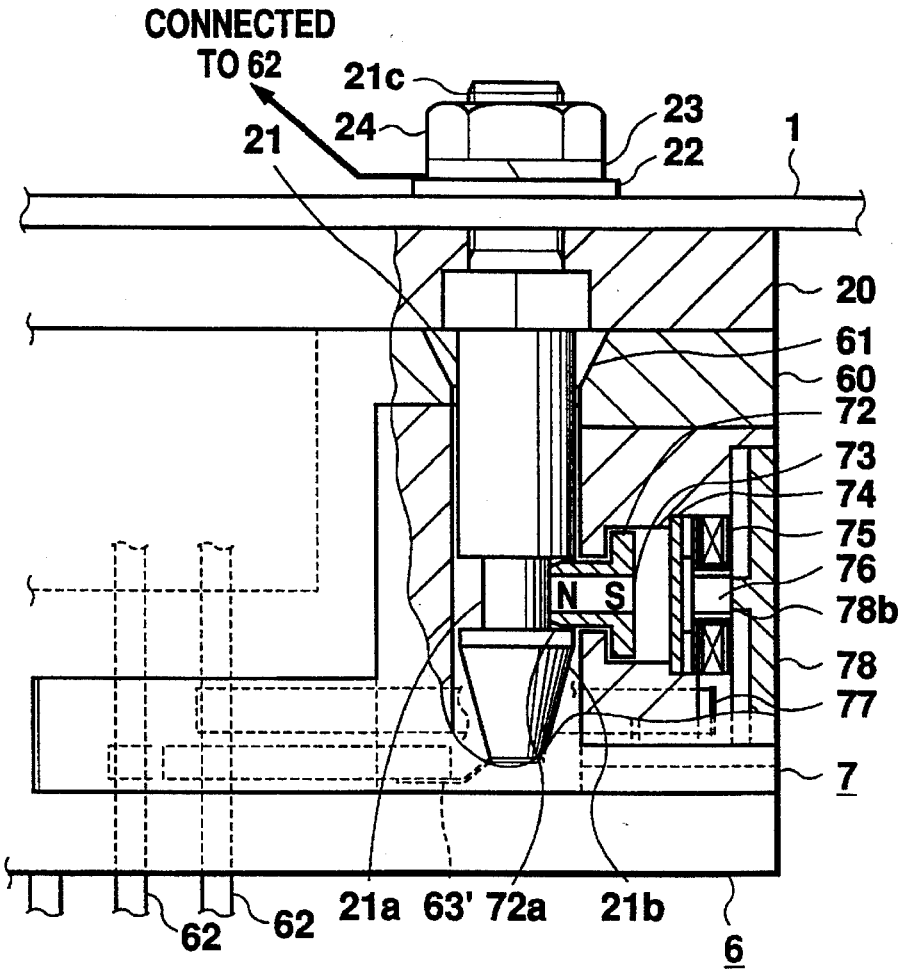
FIG. 7 is a top plan view of a lock mechanism and the periphery according to a third embodiment of the present invention.
Figure 8:
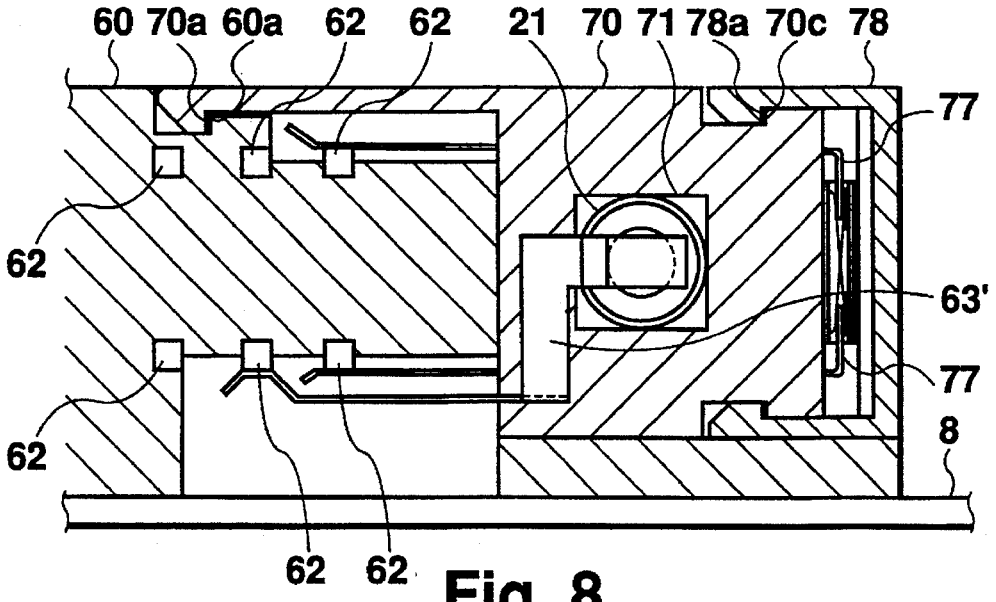
FIG. 8 is a front plan view of the lock mechanism and the periphery according to the third embodiment of the present invention.

FIGS. 7 and 8 shows an example of output path of a detection signal from the engaging state detecting means for detecting whether the male connector 2 is normally engaged with the female connector 6, as described in the first embodiment. In FIGS. 7 and 8, the same components as those in the first embodiment described with reference to FIGS. 3 to 5 are assigned with the same reference numerals and the description will be omitted.

A contact lead 63' is arranged at a portion to which the tip portion of the guide pin 21 contacts when the guide pin 21 is inserted into the guide bore 61. Another side of the contact lead 63' is connected to a predetermined one of the connector pins 62 incorporated in the female connector 6 and performing signal transfer with each of control units, in the same manner as the contact terminal 77 connected to the lead line 75*a* of the coil 75 of the electromagnet. On the other hand, the opposite end portion of the guide pin 21 (on the screw section 21*c* side) is connected to a signal line in the same manner as in the first embodiment, which is thus connected to a predetermined contact pin 62.

In this manner, by outputting the detection signal from the engaging state detecting means using the connector pin for the control unit, the connector device can be down sized and reduced in cost without the need to provide a new control line.

FOURTH EMBODIMENT

Figure 9:
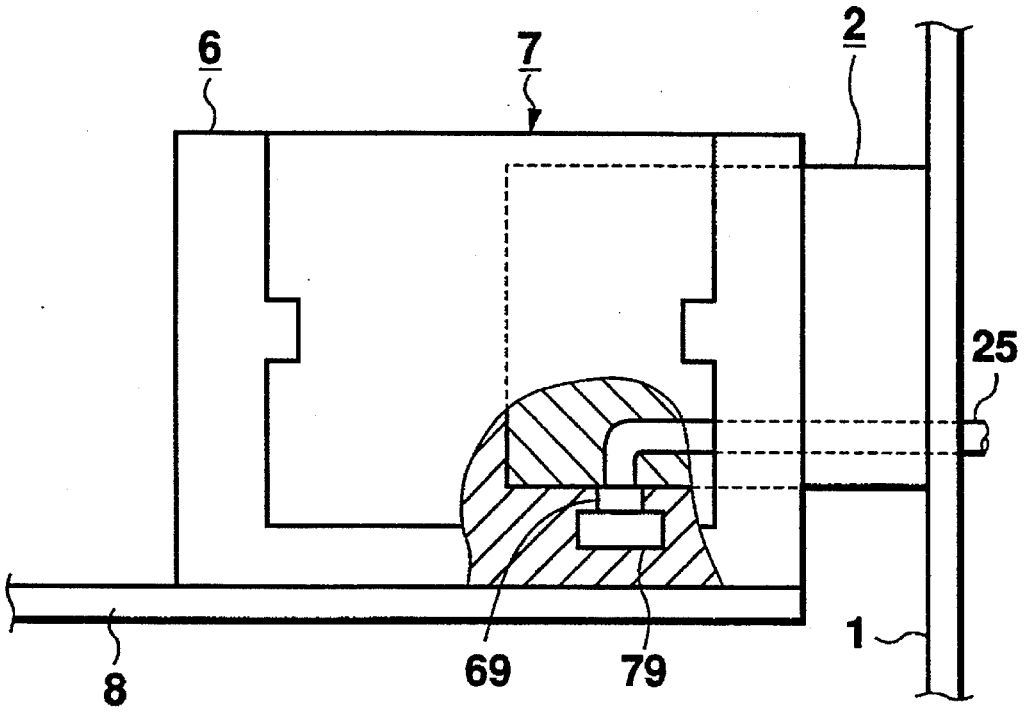
FIG. 9 is a schematic diagram showing a detecting mechanism of an engagement state of a connector device according to a fourth embodiment of the present invention.

FIG. 9 is a side plan view of the engaging state detecting means of the connector according to another embodiment of the present invention. The feature of the present embodiment is that the engaging state detection is performed using light.

In FIG. 9, the male connector 2 mounted to the back panel 1 is provided with a light guiding body 25 for guiding light incident from an external light emitting section. A light guiding bore 69 is provided on the side of the female connector 6 (or the lock mechanism unit 7 mounted on the female connector 6) and a photo-electric conversion element 79 as a light receiving section is arranged at the deep portion of the light guiding bore 69. When the male connector 2 is inserted into and engaged with the female connector 6 at a predetermined position, the light guided by the light guiding body 25 is incident to the photo-electric conversion element 79 via the light guiding bore 69. As a result, the photo-electric conversion element 79 converts the received light into electric energy. The electric energy is output to the host processing system (not shown) as the detection signal. In this manner, the engagement between the male connector 2 and the female connector 6 is detected. Thus, because the light is used for detecting the engaging state, the engagement detection can be performed with less noise and high reliability.

It should be noted that because the photo-electric conversion element as the light receiving section is arranged on the inside of the light guiding bore 69, the conversion element responds only to the light from the light emitting section, without being influenced by external light, resulting in good engagement detection.

As another embodiment of engagement detection using light, the female connector 6 is provided with a photo-coupler and the light path of the photo-coupler is shielded by a projection portion provided to the male connector 2. Even in a case that an optical fiber is used, in place of the light guiding body 25, to guide light to a portion close to the light receiving section the same effect can be achieved.

FIFTH EMBODIMENT

Figure 10:
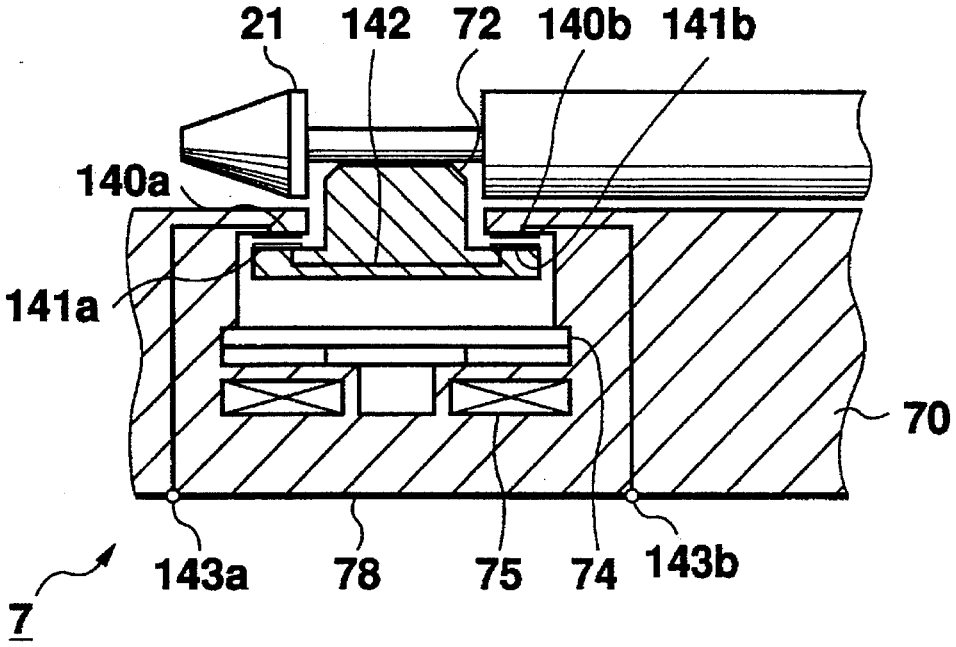
FIG. 10 is a schematic diagram showing a detecting mechanism of a locking state of a connector device according to a fifth embodiment of the present invention.

FIG. 10 is a schematic diagram showing an example in which a locking state detecting means is provided for detecting a locking state in the lock mechanism unit of the connector device according to the fifth embodiment of the present invention. In the present embodiment, the same component as those in FIG. 3 are assigned with the same reference numerals and the description will be omitted. The feature of the present embodiment is that the locking state detecting means is provided for detecting that the lock piece is moved to lock the guide pin.

In FIG. 10, the housing 70 of the lock mechanism unit 7 is provided with stopper contact leads 140*a* and 140*b* at a stopper section, i.e., a contact section to which the lock piece 72 contacts in the locking state. On the other hand, lock piece contact leads 141*a* and 141*b* are provided at the position where they can contact the stopper contact leads 140*a* and 140*b* of the lock piece 72, respectively. The lock piece contact leads 141*a* and 141*b* are connected to each other by a lead line 142 in the lock piece and the stopper contact leads 140*a* and 140*b* are connected to terminals 143*a* and 143*b* provided to the lock mechanism unit 7 to respectively output detection signals to the host processing system.

Next, the operation of the locking state detecting means of the connector device of the present embodiment will be described below. The method of engaging and locking in the connector device is the same as described in the first embodiment.

In a locking state, the lock piece 72 is attracted to the guide pin 21. At this time the stopper contact lead 140*a* contacts the lock piece contact lead 141*a* to establish a conductive state. Also, the stopper contact lead 140*b* contacts the lock piece contact lead 141*b* to establish a conductive state. Thereby, the conductive state is established between the terminal 143*a* and the terminal 143*b*. It can be electrically confirmed based on the conducive state indicating signals that the lock mechanism is in the locking state. The detection signal output based on the conductive states is input to the host processing system.

On the contrary, in an unlocked state, the lock piece 72 is repulsed from the guide pin 21 to be attracted to the iron piece 74. Therefore, the stopper contact lead 140*a* separates from the lock piece contact lead 141*a* to establish a non-conductive state. Also, the stopper contact lead 140*b* separates from the lock piece contact lead 141*b* to establish a non-conductive state. Thereby, the non-conductive state is established between the terminal 143*a* and the terminal 143*b*. The unlocking state of the lock mechanism can be electrically confirmed based on the non-conductive state signal. Therefore, the connector device in which the lock/unlocking state can be detected with a simple structure is provided with high reliability.

SIXTH EMBODIMENT

Figure 11:
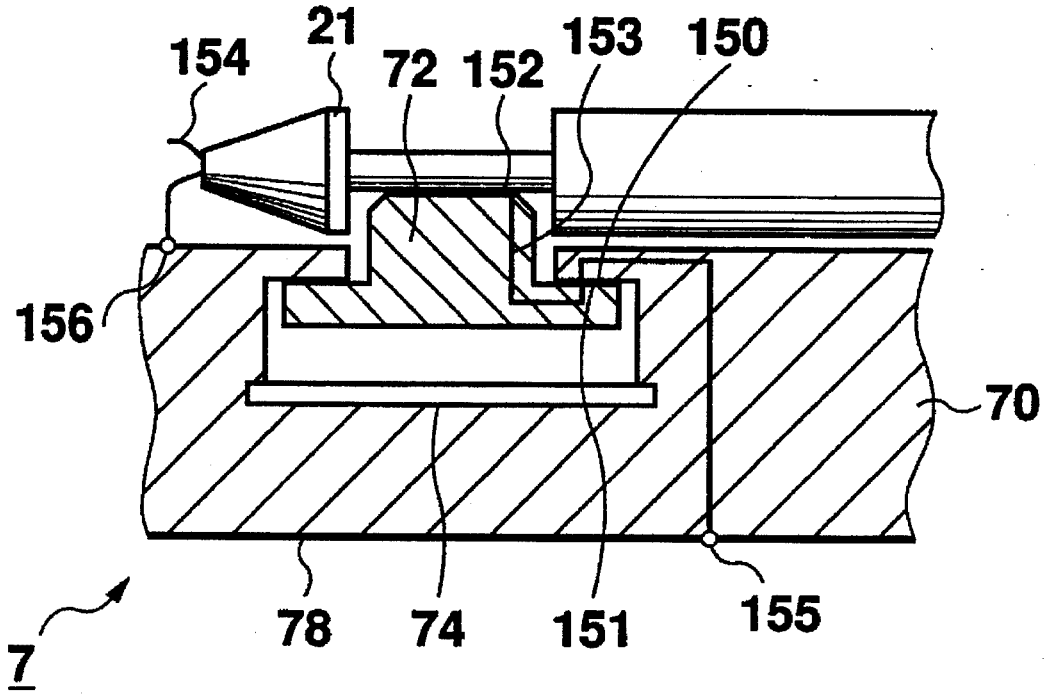
FIG. 11 is a schematic diagram showing a detecting mechanism of a locking state of a connector device according to a sixth embodiment of the present invention.

FIG. 11 is a cross sectional view of another embodiment of the locking state detecting means for detecting the locking state in the lock mechanism unit 7. In FIG. 11, the same components as those in FIG. 3 are assigned with the same reference numerals and the description will be omitted.

In FIG. 11, a stopper contact lead 150 provided at a lock piece stopper section of the housing 70 of the lock mechanism unit 7, i.e. a contact section which the lock piece 72 contacts when it is locked, contacts a first lock contact lead 151 provided at a position of the lock piece 72 corresponding to the stopper contact lead 150 when the lock is performed. The stopper contact lead 150 is connected to a terminal 155. On the other hand, a second lock piece contact lead 152 is provided at a portion where the lock piece 72 contacts the guide pin 21 made of metal when it is locked. The first lock piece contact lead 151 and the second lock piece contact lead 152 are connected to each other by a lead line 153. A flat spring 154 is arranged in the guide bore 61 (see FIG. 3) at a position where the tip portion of the guide pin 21 is in contact when the guide pin 21 is inserted and the flat spring 154 is connected to the terminal 156.

Next, the operation of the locking state detecting means of the connector device according to the present embodiment will be described below. The method of engaging and locking in the connector device is the same as described in the first embodiment.

When the guide pin 21 made of metal or the like is inserted into the guide bore 61, the guide pin 21 contacts the flat spring 154 to establish a conductive state. On the other hand, the lock piece 72 is attracted to the guide pin 21 in the locking state. At this time the stopper contact lead 150 contacts the first lock piece contact lead 151 to establish a conductive state. Also, the second lock piece contact lead 152 contacts the guide pin 21 to establish a conductive state. Thereby the conductive state is established between the terminal 155 and the terminal 156. By recognition of the conductive state indicating signal by the host processing system, it can be electrically confirmed that the lock mechanism is in the locking state.

When the locking state is to be unlocked, the lock piece 72 separates from the guide pin 21 to be attracted to the iron piece 74 to establish a non-conductive state. Also, the contact lead 150 separates from the contact lead 151 to establish a non-conductive state. Thereby, a non-conductive state is established between the terminal 155 and the terminal 156. It can be electrically confirmed by the non-conductive state indicating signal that the lock mechanism is in the unlocking state. Therefore, the connector device which can detect the lock/unlocking state can be provided with a simple structure and with high reliability, as in the above fifth embodiment.

SEVENTH EMBODIMENT

Figure 12:
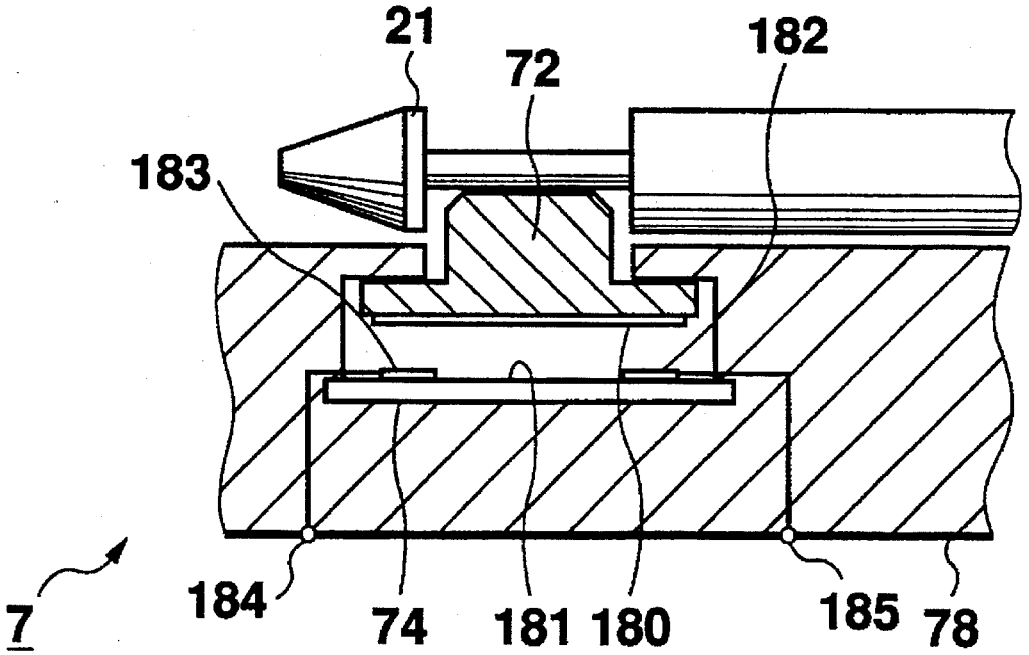
FIG. 12 is a schematic diagram showing a detecting mechanism of a locking state of a connector device according to a seventh embodiment of the present invention.

FIG. 12 is a cross sectional view of another embodiment of the locking state detecting means for detecting the locking state in the lock mechanism unit 7. In FIG. 12, the same components as those in FIG. 3 are assigned with the same reference numerals and the description will be omitted.

In FIG. 12, the lock piece 72 has a lock piece contact lead 180 on the bottom surface. On the other hand, an insulation plate 181 is arranged on the iron piece 74 and a contact lead 182 connected to a terminal 185 and contact lead 183 connected to a terminal 184 are provided on the top surface of the insulation plate 181 with a predetermined distance between them.

Next, the operation of the locking state detecting means of the connector device according to the present embodiment will be described below. The method of engaging and locking in the connector device is the same as described in the first embodiment.

The lock piece 72 is attracted to the guide pin 21 in the locking state. At this time, a non-conductive state is established between the lock piece contact lead 180 and the contact leads 182 and 183 on the insulation plate 181. Therefore, a non-conductive state is also established between the terminal 184 and the terminal 185. The host processing system recognizes a detection signal indicative of the non-conductive state and can electrically confirm that the lock mechanism is in the locking state.

When the locking state is to be unlocked, as the lock piece 72 separates from the guide pin 21 to be attracted to the iron piece 74, the lock piece contact lead 180 contacts the contact leads 182 and 183 to establish a conductive state. Therefore, a conductive state is also established between the terminal 184 and the terminal 185. The host processing system recognizes the detection signal indicative of the conductive state and can electrically confirm that the lock mechanism is in the unlocking state. Therefore, the connector device which can detect the lock/unlocking state can be provided with a simple structure and with high reliability.

EIGHTH EMBODIMENT

Figure 13:
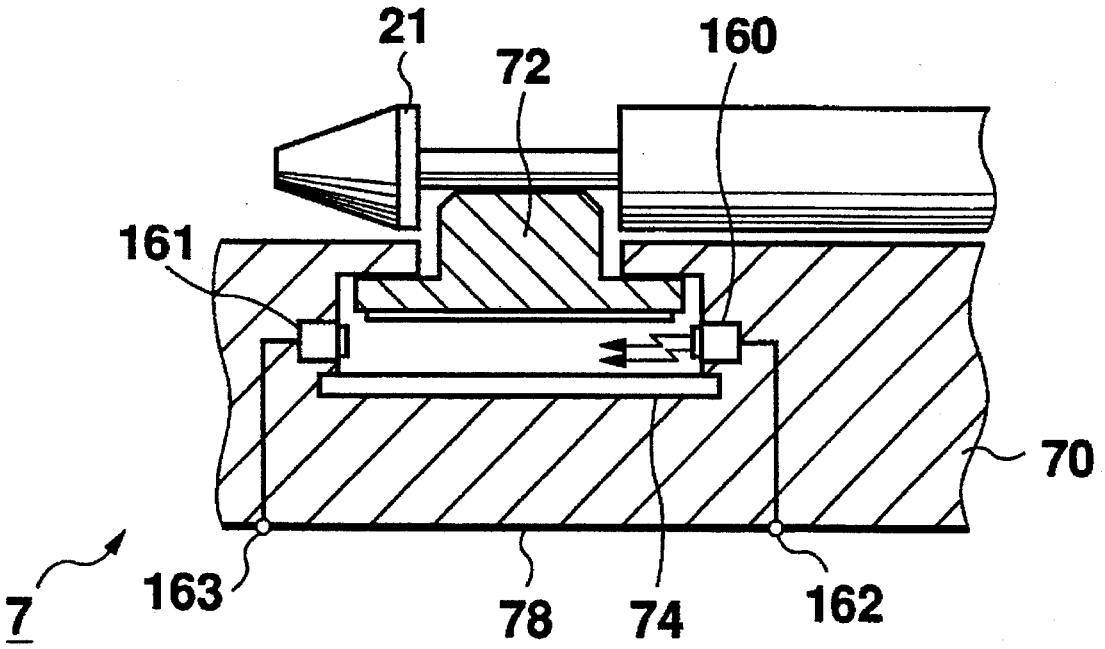
FIG. 13 is a schematic diagram showing a detecting mechanism of a locking state of a connector device according to an eighth embodiment of the present invention.

FIG. 13 is a schematic diagram showing another embodiment of the locking state detecting means for detecting the lock/unlocking state in the lock mechanism unit 7. In the present embodiment the lock/unlocking state can be detected based on the transmitting state of light on a light path formed of a light emitting section and a light receiving section. In FIG. 13, the same component as those in FIG. 3 are assigned with the same reference numerals and the description will be omitted.

In FIG. 13, a light emitting element 160 is arranged in the retractable section of the lock piece 72 provided in the housing 70 of the lock mechanism unit 7 and a light receiving element 161 is arranged at the position facing to the light emitting element. The light emitting element 160 is supplied with electrical power from a terminal 162 and a detection signal from the light receiving element 161 is output from a terminal 163.

Next, the operation of the locking state detecting means of the connector device according to the present embodiment will be described below. The method of engaging and locking in the connector device is the same as described in the first embodiment.

The lock piece 72 is attracted to the guide pin 21 in the locking state. Because there is not the lock piece 72 as a light shielding element is not positioned in the light path formed of the light emitting element 160 and the light receiving element 161, the light emitted from the light emitting element 160 is received by the light receiving element 161. That is, it can be electrically confirmed based on a detection signal output from the light receiving element 161 that the lock mechanism is in the locking state.

When the locking state is to be unlocked, because the lock piece 72 separates from the guide pin 21 to be attracted to the iron piece 74, the lock piece 72 shields the light emitted from the light emitting element 160. Therefore, the light receiving element 161 cannot receive the light and stops the operation of outputting the detection signal. Therefore, the host processing system cannot get the detection signal indicative of the locking state and electrically confirms that the lock mechanism is in the unlocking state.

Figure 14:
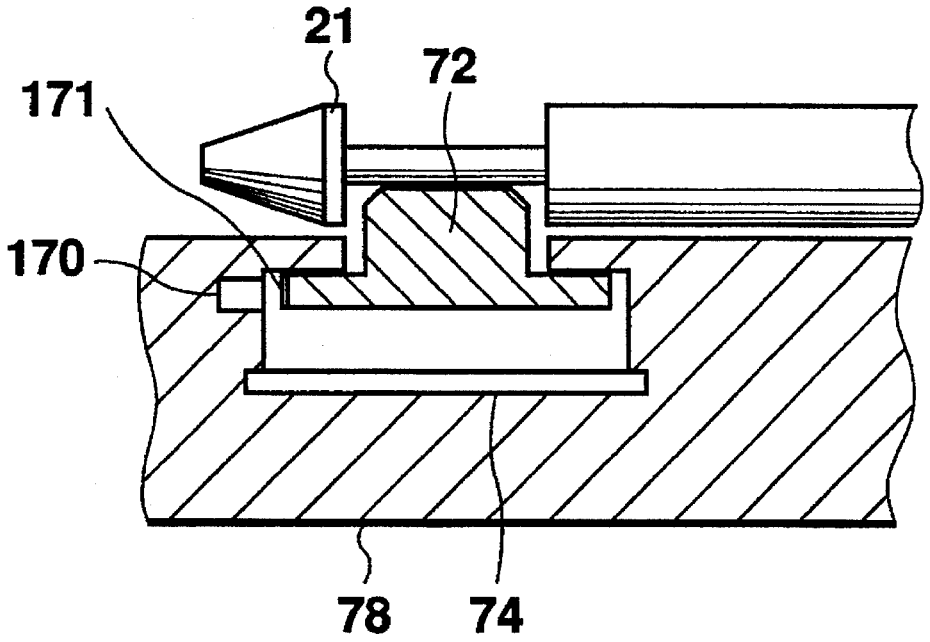
FIG. 14 is a schematic diagram showing another detecting mechanism of a locking state of a connector device according to the eighth embodiment of the present invention.

FIG. 14 shows an example in which a reflective type of photo sensor is used as the locking state detecting means. As shown in FIG. 14, the reflective type of photo sensor 170 is arranged in a cavity section provided in the housing 70. A reflecting plate 171 is arranged at the side of the lock piece 72 so as to face the reflective type of photo sensor 170 when the lock piece 72 is in the locking state. As described above, the reflective type of photo sensor 170 receives the light reflected by the reflecting plate 171 in the locking state and outputs a detection signal indicative of the locking state. The reflective type of photo sensor 170 cannot receive the reflected light in the unlocked states and therefore does not output the detection signal. Therefore, even in a case of using the reflective type of photos sensor, it can be electrically confirmed that the lock mechanism is in the lock/unlocking state.

Therefore, the connector device which can detect the lock/unlocking state can be provided with a simple structure and with high reliability, as in the above fifth, sixth and seventh embodiments.

NINTH EMBODIMENT

Figure 15:
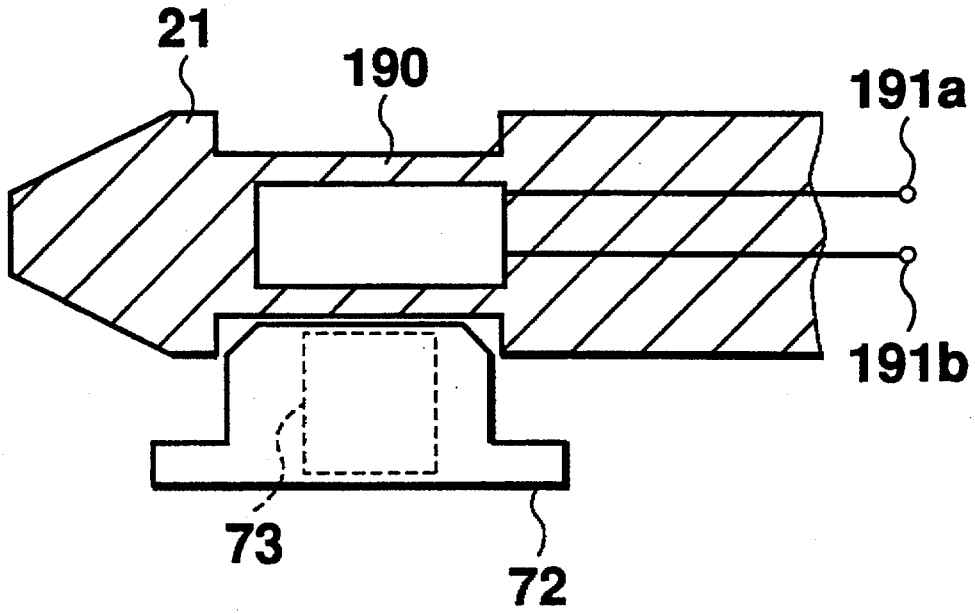
FIG. 15 is a schematic diagram showing a detecting mechanism of a locking state of a connector device according to a ninth embodiment of the present invention.

FIG. 15 is a schematic diagram showing another embodiment of the locking state detecting means for detecting the locking state in the lock mechanism unit 7. In the present embodiment, a magnetic field sensing type of relay is used for detecting the locking state. Since FIG. 15 is the same as FIG. 3, except for the guide pin 21 and the lock piece 72, the same portion is omitted in the figure and the same components as those in FIG. 3 are assigned with the same reference numerals and the description will be omitted.

In FIG. 15, a reed relay 190 is provided in the inside portion of the guide pin 21 to which the lock piece 72 is attracted and lead lines connected to the reed relay 190 are provided at the terminals 191*a* and 191*b*.

Next, the operation of the locking state detecting means of the connector device according to the present embodiment will be described below. The method of engaging and locking in the connector device is the same as described in the first embodiment.

The lock piece 72 is attracted to the guide pin 21 in the locking state. At this time, the contact of the reed relay 190 provided in the guide pin 21 is closed due to the magnetic force of the permanent magnet 73 which is provided in the lock piece 72. Thus, a conductive state is established between the terminal 191*a* and the terminal 191*b*. The host processing system can electrically confirm, based on a detection signal indicative of the conductive state, that the lock mechanism is in the locking state.

On the other hand, when the locking state is to be unlocked, the lock piece 72 separates from the guide pin 21 to be attracted to the iron piece 74 (see FIG. 3). At this time, because the magnetic force due to the permanent magnet 73 of the lock piece 72 does not act on the reed relay 190, the contact of the reed relay 190 is opened. Thus, a non-conductive state is established between the terminal 191a and the terminal 191*b*. Therefore, the host processing system can electrically confirmed, based on the detection signal indicative of the non-conductive state, that the lock mechanism is in the unlocking state.

Therefore, the connector device which can detect the lock/unlocking state can be provided with a simple structure and with high reliability, as in the above fifth to eighth embodiments. It should be noted that although the reed relay is used as the magnetic field sensing type of relay in the present embodiment, the same effect can be achieved even if another magnetic field sensing type of relay such as a Hall effect element.

TENTH EMBODIMENT

Figure 16A:
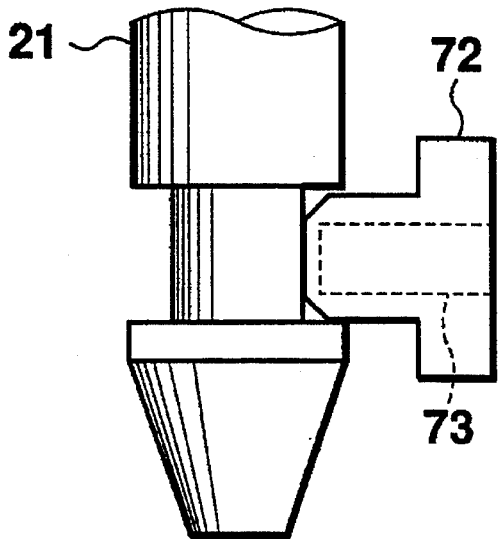
FIG. 16A is a side plan view of a lock piece having a curved surface to explain the preferred shapes of a guide pin and the lock piece in a connector device according to a tenth embodiment of the present invention.
Figure 16B:
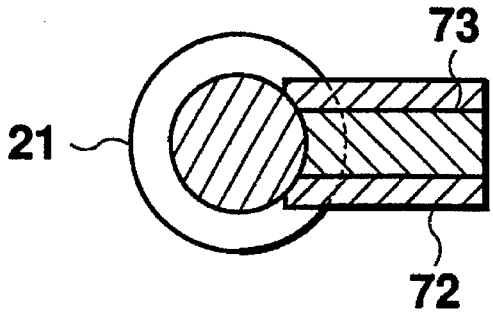
FIG. 16B is a cross sectional view of a lock piece having a curved surface to explain the preferred shapes of a guide pin and the lock piece in a connector device according to the tenth embodiment of the present invention.
Figure 16C:
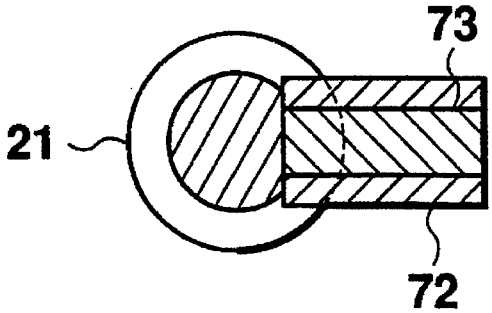
FIG. 16C is a cross sectional view of a lock piece having a flat surface to explain the preferred shapes of a guide pin and the lock piece in a connector device according to the tenth embodiment of the present invention.

FIGS. 16A, 16B and 16C are schematic diagrams showing preferred shapes of the guide pin and lock piece in each of the above embodiments.

In each embodiment, the lock piece 72 is attracted to the guide pin 21 through the polarity exchange of the electromagnet (see FIG. 3). Since the supply of current is stopped after the attraction, the lock piece 72 needs to be kept in the attraction state to the guide pin 21 by the magnetic force of the permanent magnet 73. Therefore, both the lock piece 72 and the guide pin 21 have contact faces fitted to each other as shown in FIGS. 16A and 16B. For instance, a portion of the lock piece 72 contacting the guide pin 21 is formed to have the same radius of curvature as that of the curved surface of the guide pin 21. The curved surface of the lock piece 72 makes full planar contact with guide pin 21. Therefore, the attraction state of the lock piece 72 and the guide pin 21 is kept in a good state, so that the stable and rigid locking state can be achieved.

In the above embodiment, there is described a case where the curved surface of the lock piece 72 has the same radius of curvature as that of the curved surface of the guide pin 21. However, as shown in FIG. 16*c*, the contact surfaces of the lock piece 72 and guide pin 21 may be cut so as to be flat. Even in this case, the same effect can be obtained.

ELEVENTH EMBODIMENT

Figure 17:
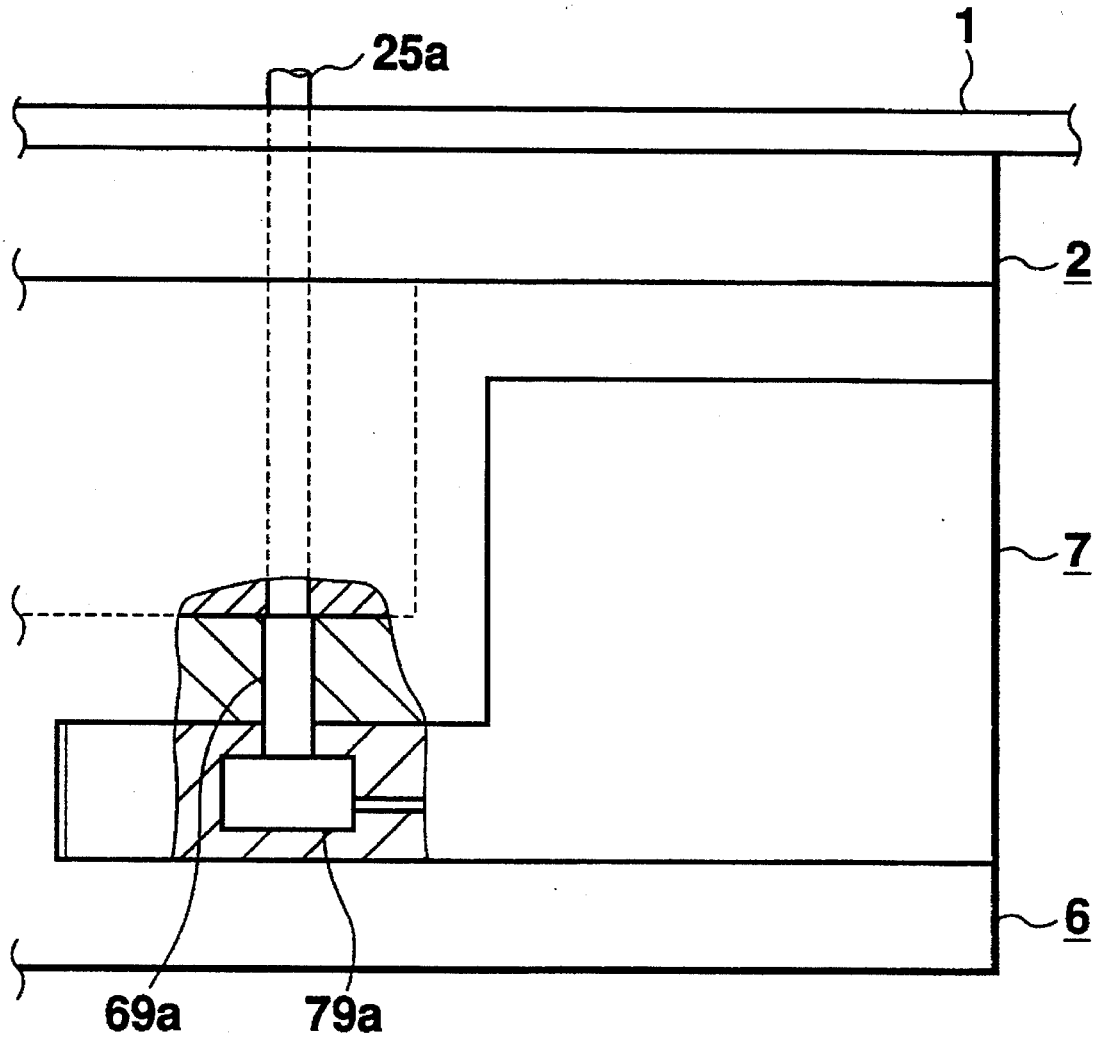
FIG. 17 is a top plan view of lock/unlock means which is driven by electrical energy generated by a photo-electric converting element in a connector device according to an eleventh embodiment of the present invention.
Figure 18:
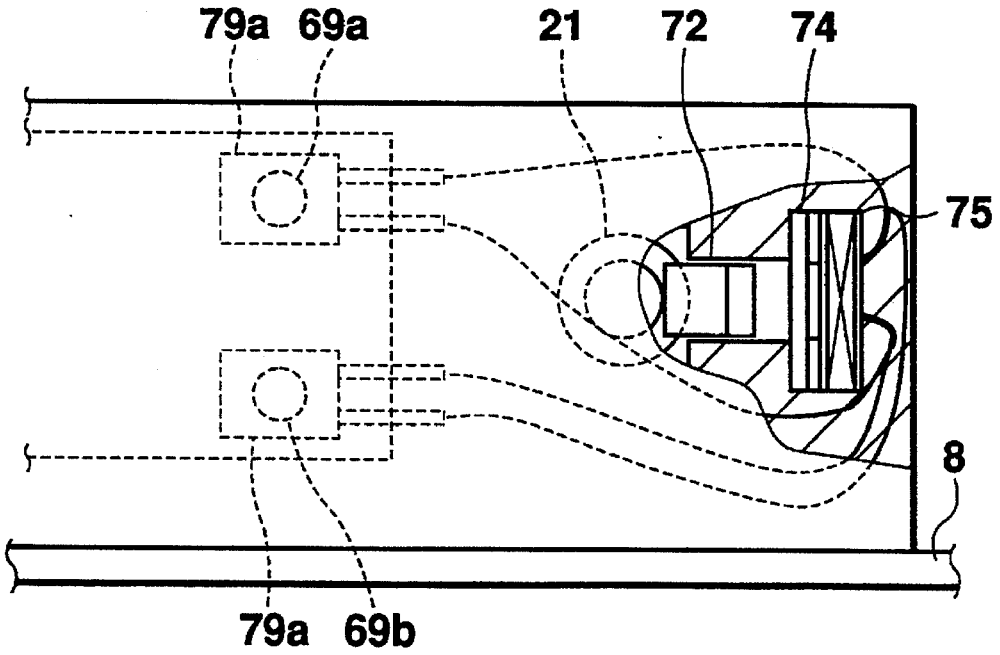
FIG. 18 is a front plan view of the lock/unlock means which is driven by the electrical energy generated by the photo-electric converting element in the connector device according to the eleventh embodiment of the present invention.
Figure 19:
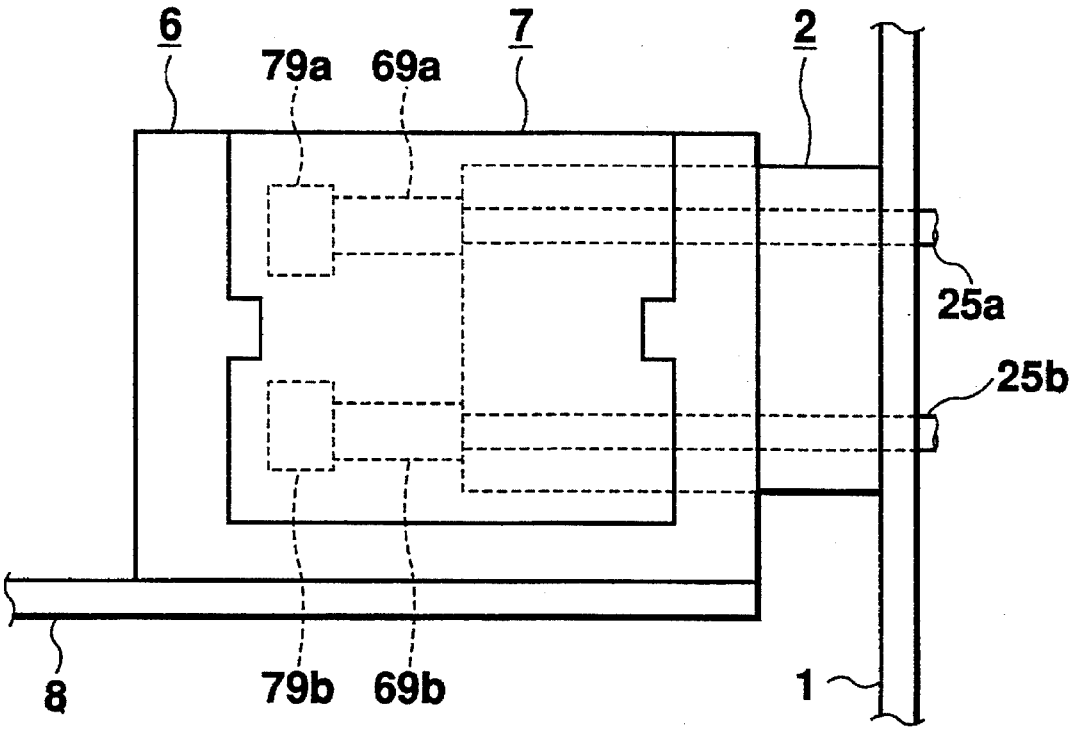
FIG. 19 is a side plan view of the lock/unlock means which is driven by the electrical energy generated by the photo-electric converting element in the connector device according to the eleventh embodiment of the present invention.

FIGS. 17 to 19 are schematic diagrams showing an embodiment in which the lock/unlock operation of the connector device is performed using light energy. In FIGS. 17 to 19, the same components as those in FIG. 3 are assigned with the same reference numerals and the description will be omitted.

In FIGS. 17 to 19, the male connector 2 mounted to the back panel 1 is provided therein with light guiding bodies 25*a* and 25*b* for guiding light incident from an external light emitting section. Light guiding bores 69*a* and 69*b* are provided on the lock mechanism unit 7 mounted on the female connector 6 and photo-electric conversion elements 79*a* and 79*b* are arranged at the deep end portions of the light guiding bores 69*a* and 69*b*. Output terminals of the photo-electric conversion elements 79*a* and 79*b* are respectively connected to the coil 75 of the electromagnet.

Next, the operation of the present embodiment will be described below.

Light emitting means emits light in response to a lock instruction from the host processing system. When the light guided by the light guiding body 25*a* is incident to the photo-electric conversion element 79*a* via the light guiding bore 69*a*, the photo-electric conversion element 79*a* converts the received light into electrical energy and supplies the electrical energy to the coil 75 of the electromagnet as current. At this time the current supplied from the photo-electric conversion element 79*a* flows such that the coil 75 is energized with a direction of magnetic field in which the lock piece 72 is moved to the guide pin 21. Thus, by irradiating light to the light guiding body 25*a*, the lock piece 72 is repulsed from the electromagnet and attracted to the guide pin 21 and the connector device can be locked.

On the other hand, when the light emitting means emits light in response to a lock unlock instruction from the host processing system, the light guided by the light guiding body 25*b* is incident to the photo-electric conversion element 79*b* via the light guiding bore 69*b*. The photo-electric conversion element 79*b* converts the received light into electrical energy and supplies the electrical energy to the coil 75 of the electromagnet as current. At this time the current supplied from the photo-eclectic conversion element 79*b* flows such that the coil 75 is energized with a direction of magnetic field in which the lock piece 72 is moved to the iron piece 74. Thus, by irradiating light to the light guiding body 25*b*, the lock piece 72 is attracted by the electromagnet and separated from the guide pin and the locking state of the connector device can be unlocked.

According to the present embodiment, after the male connector 2 and the female connector 6 are completely engaged with each other, the electromagnet starts to drive. Therefore, it is not necessary to provide a mechanism for confirming the engagement between the male connector 2 and the female connector 6. In addition, since the lock/unlock control of the connector device is performed using light, external noise has no influence and the connector device can be obtained with high reliability.

TWELFTH EMBODIMENT

Figure 20:
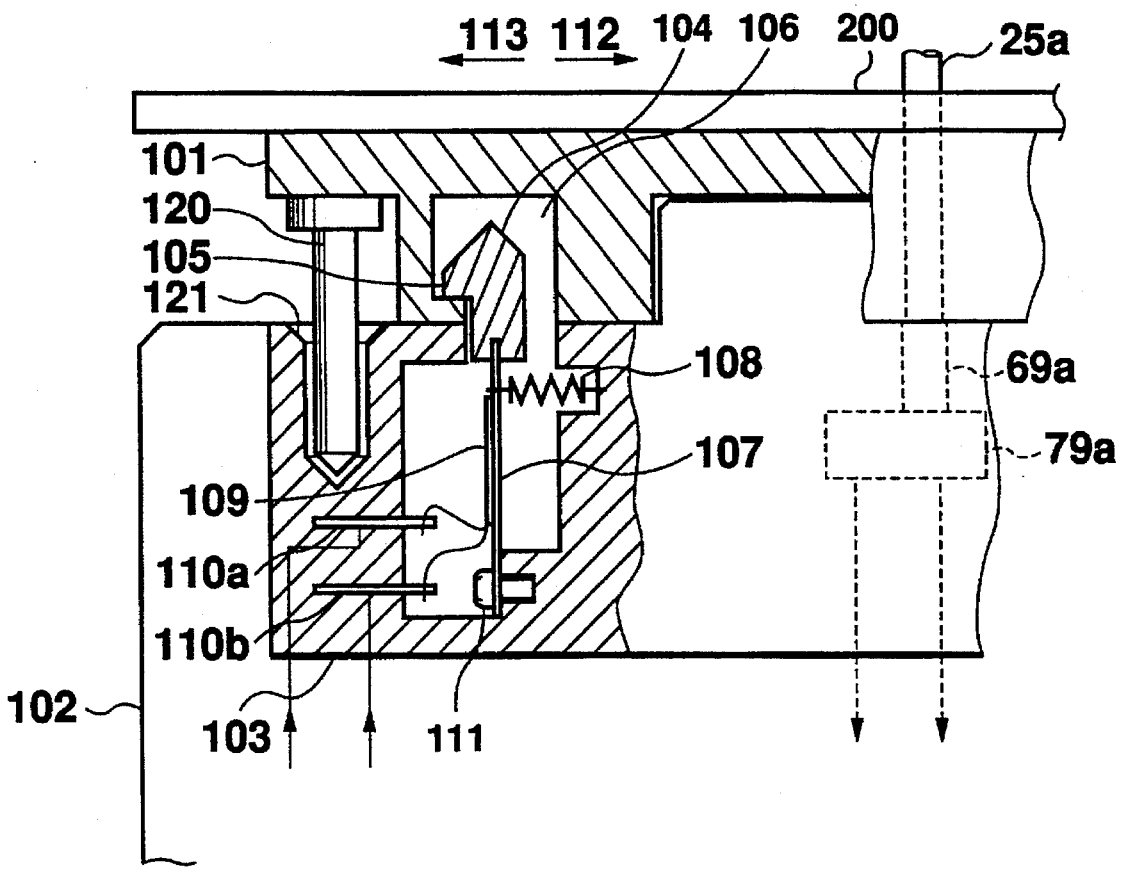
FIG. 20 is a top plan view of a lock mechanism unit and the periphery according to a twelfth embodiment of the present invention.

FIG. 20 is a schematic diagram showing another embodiment of the connector device which includes therein the lock mechanism unit according to the present invention. The feature of the present embodiment is that guide means for guiding the engagement between the male connector and the female connector and lock/unlock means for maintaining or unlocking the engagement between the male connector and the female connector are provided separately from each other. FIG. 20 shows only the lock/unlock means of the connector device and the other portion is omitted because it is the same as in the first embodiment.

In FIG. 20, the male connector 101 is provided to the back panel 200 and a pair of guide pins 120 which act as the guide in the engagement with the female connector are respectively provided at the ends of male connector 101. On the other hand, a female connector 103 mounted on a printed circuit board 102 is provided with guide bores 121 which engage with the guide pins 120. A heat deformable member such as a flat spring 107 made of shape memory alloy and fixed by a fixing screw 111 is arranged in the female connector 103. A lock member 104 having a claw section 105 which can engage with the dent portion 106 provided to the male connector 101 is fixed to the free end of the flat spring 107. That is, a movable lock piece is formed by the flat spring 107 and the lock member 104. A tape heater 109 connected to terminals 110*a* and 110*b* is provided on the surface of the flat spring 107 as heating means for heating the flat spring 107.

Normally, the lock member 104 is pressed by a coil spring 108 provided to the flat spring 107 in a direction shown by an arrow 112 in the figure and the unlocking state is established. In this state, the male connector 101 is engaged with the female connector 103. When the engagement between the male connector 101 and the female connector 103 is confirmed by a normal method, the power is supplied to the tape heater 109 via the terminals 110*a* and 110*b* so that the flat spring 107 is heated up. The spring coefficient of the flat spring made of shape memory alloy becomes greater, and the lock member 104 is moved in a direction shown by an arrow 113 against the pressure of the coil spring 108. As a result, the claw section 105 provided to the lock member 104 engages with the dent portion 106 of the male connector 101 so that the male connector 101 and the female connector 103 enter into the locking state.

When the power supply to the tape heater 109 is stopped, the flat spring 107 is cooled and the spring coefficient of the flat spring 107 becomes smaller. As a result, the lock member 104 is moved in a direction shown by the arrow 112 by the pressure of the coil spring 108. Therefore, the locking state of the lock member 104 is unlocked.

As described above, because the guide means and the lock/unlock means of the male and female connectors are provided separately from each other, the improvement of the male and female connectors or guide means and lock/unlock means can be freely performed without any constraint. In addition, in the present embodiment, although the description is given using shape memory alloy as the heat deformable member constituting the flat spring, the same effect can be achieved using a bimetal. Further, in the present embodiment, the tape heater is used to heat the flat spring. However, a heater may be used in place of the tape heater. Furthermore, there is given the description that the lock member is fixed to the connector device at a single position on a single side. However, the lock member may be fixed to the connector at two positions on the opposing sides or a single position at the center. In addition, by use of the photo-electric conversion element 79*a* described in the eleventh embodiment, the light energy is converted into the electric energy by which the tape heater 109 may be heated up. In this case, since the tape heater start to be heated up after the male and female connectors are completely engaged with each other, the engagement confirming mechanism for the male and female connectors need not to be provided separately. Also, the connector device can be obtained with less influence from external noise and with high reliability because the lock/unlock control of the connector device is performed using light.

THIRTEENTH EMBODIMENT

FIGS. 21 to 24 show examples of an electronic apparatus to which the above connector device is applied.

Figure 21:
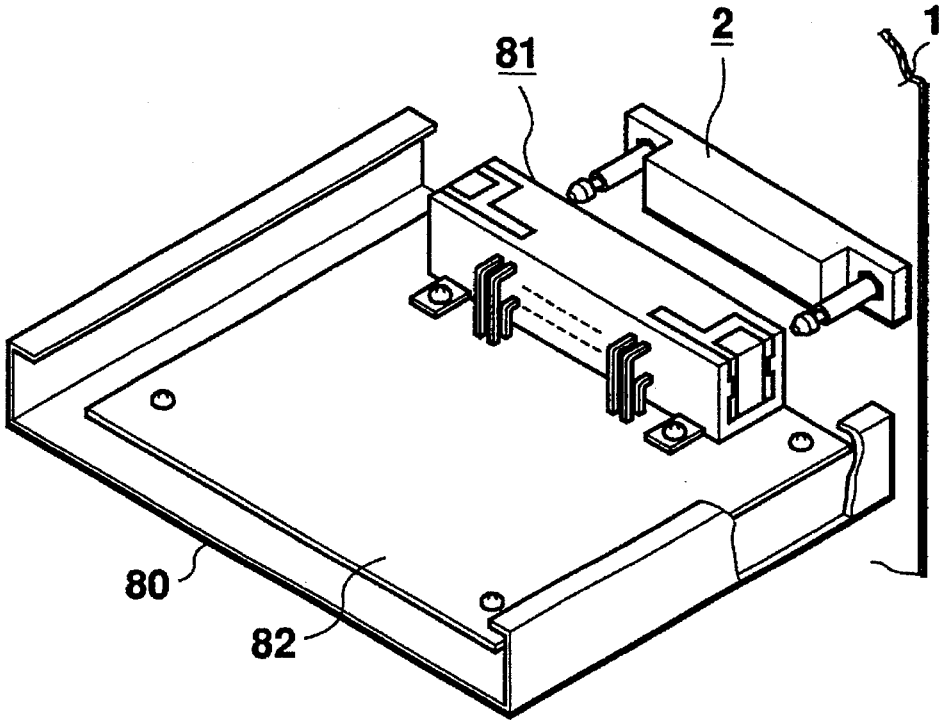
FIG. 21 is a schematic diagram showing an example in which a connector device is applied to a plug-in unit according to a thirteenth embodiment of the present invention.

FIG. 21 is a perspective view of a plug-in unit on which the connector device according to the present invention is mounted. In FIG. 21, the male connector 2 mounted on the back panel 1 can engage with the female connector 81 fixed to a printed circuit board 82 incorporated into the plug-in unit 80. The method of engaging and locking in the connector device is the same as in the first embodiment.

Figure 22:
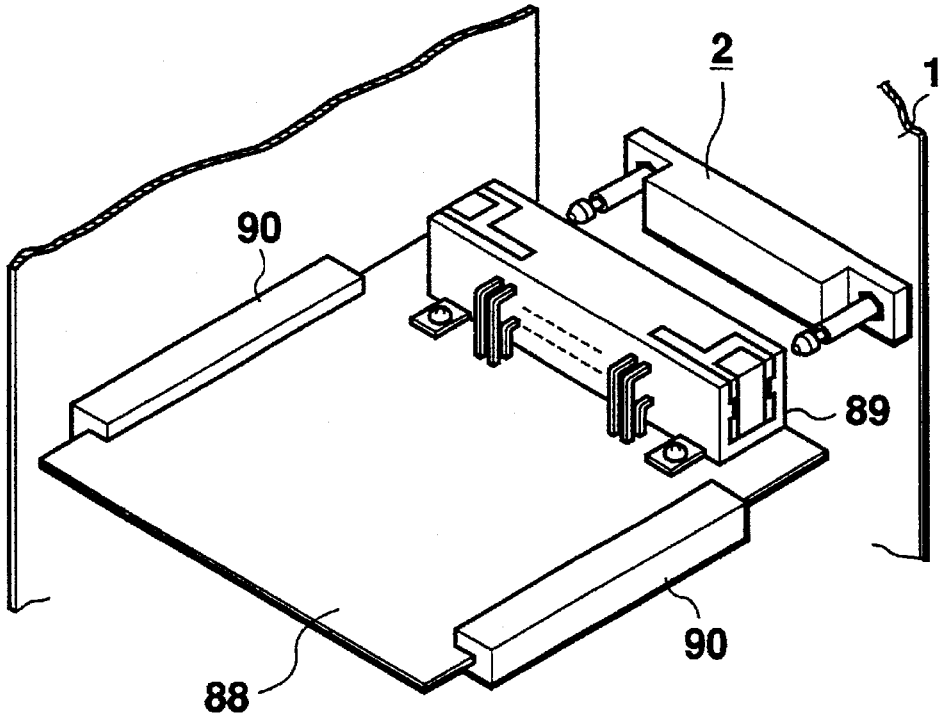
FIG. 22 is a schematic diagram showing an example in which the connector device is applied to a printed circuit board according to the thirteenth embodiment of the present invention.

FIG. 22 shows an example in which a female connector 89 of the connector device according to the present invention is mounted on a printed circuit board 88. In this case, the printed circuit board 88 is simply inserted along a guide 90 and can be pushed in or pulled out from the processing system.

Figure 23:
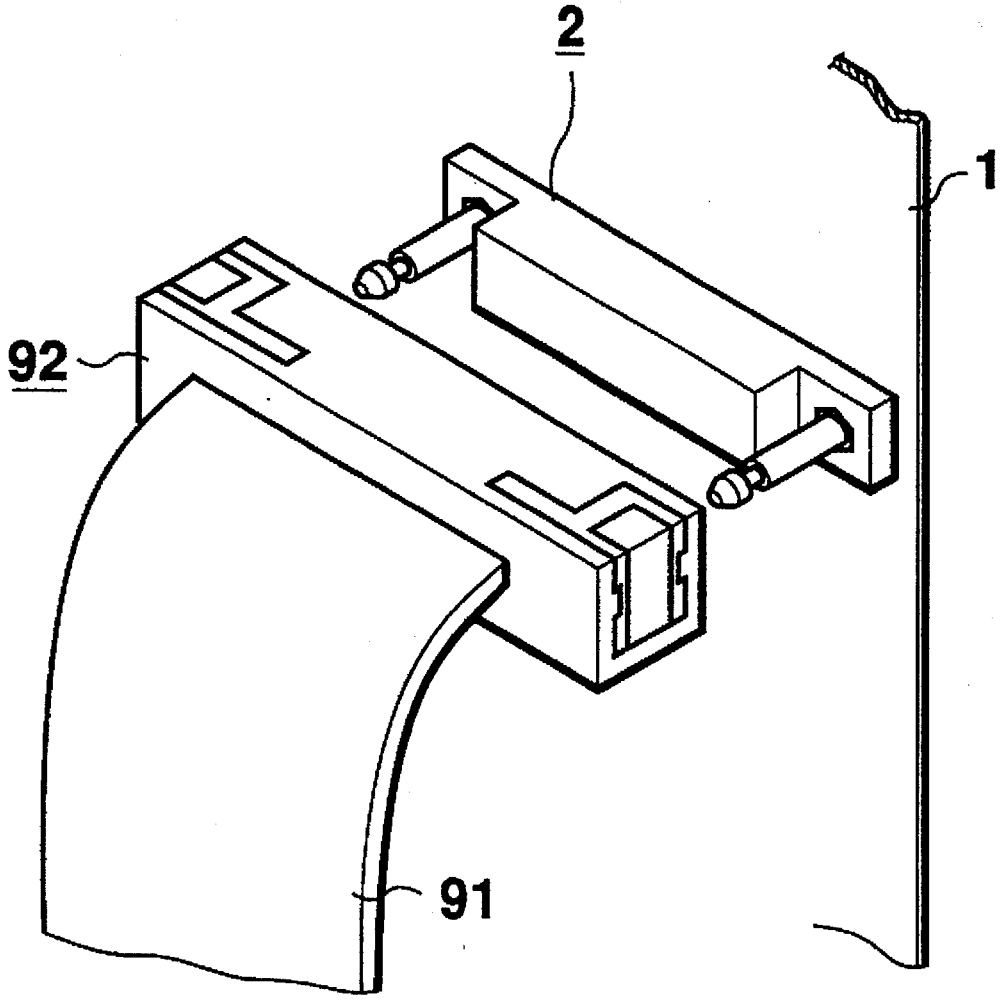
FIG. 23 is a schematic diagram showing an example in which the connector device is applied to a flat cable according to the thirteenth embodiment of the present invention.

FIG. 23 shows an example in which the female connector 92 is directly connected to a flat cable 91, which is used for connecting between a plurality of independent processing units.

Figure 24:
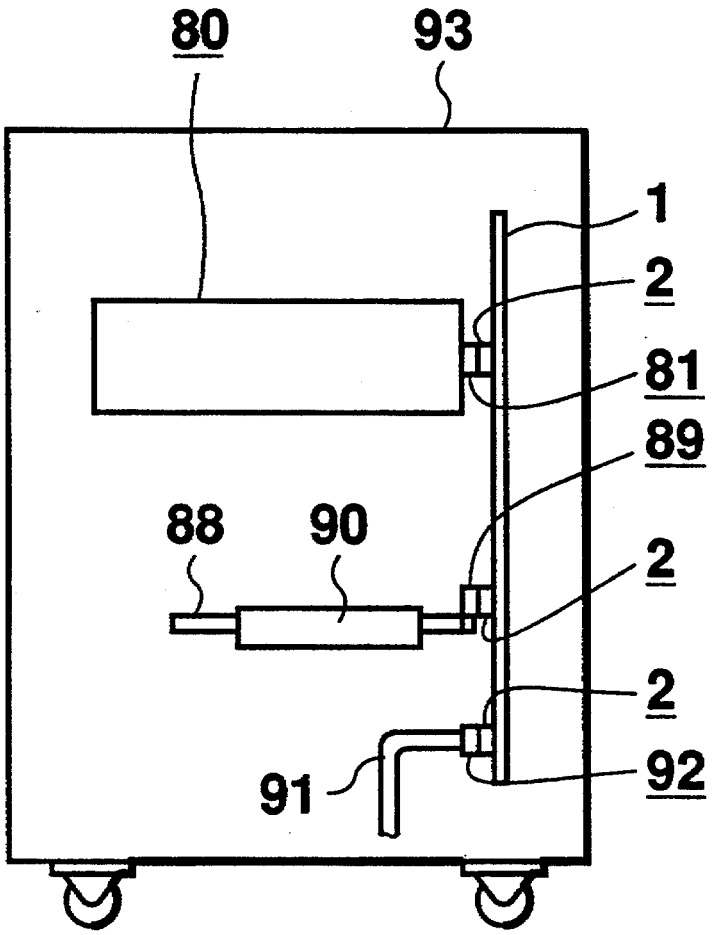
FIG. 24 is a schematic diagram showing an example in which the connector device is applied to an electronic apparatus according to the thirteenth embodiment of the present invention.

FIG. 24 is a side plan view of an electronic apparatus according to an embodiment of the present invention in which units are constructed as a system using the above application of of the connector device. In FIG. 24 a plurality of male connectors 2 mounted on a back panel 1 in the electronic apparatus 93 are connected to a plug-in unit 80, a printed circuit board 88, a flat cable 91 via female connectors.

As described above, since lock/unlock means for maintaining or unlocking the engagement of the connector device is provided in the connector device, a desired assembly precision can be obtained upon assembling the connector device. Therefore, the assembly precision of the guide means and lock/unlock means can be easily increased. In addition, as the assembly precision of the guide means and lock/unlock means can be maintained, even if the combination of the male connector and female connector is changed among a plurality of connector devices, good engagement can be achieved and it is never necessary to perform the adjustment for a new combination of male connector and female connector. Further, as it can be easily confirmed by the engaging state detecting means or locking state detecting means whether or not the engagement or locking of the connector device is reliably performed, the connector device with high reliability can be obtained.

What is claimed is:

1. A connector device comprising:

a pair of connector housings adapted to be engaged with each other and including signal connecting terminals adapted to transfer a signal;

lock/unlock means for locking and unlocking the connector housings in response to a signal provided to the connector housings, the lock/unlock means being mounted to at least one of the connector housings; and guide means for guiding the connector housings into engagement with each other, the guide means including a guide pin disposed on one of the connector housings and a guide bore disposed on the other of the connector housings, and wherein the lock/unlock means includes at least one retractable lock piece disposed in the guide bore, and the lock piece is adapted to engage a side of the guide pin to lock the connector housings.

2. The connector device according to claim 1, wherein at least one of the guide pin and the guide bore is formed as a unit with a fixing member for fixing one of the pair of connector housings to a fixed panel member.

3. The connector device according to claim 1, wherein the lock/unlock means includes an electromagnet having a changeable polarity and a permanent magnet which is adapted to be attracted to or repulsed from the electromagnet, and wherein the lock piece includes one of the electromagnet and the permanent magnet, the lock piece being adapted to be advanced toward and retracted from the guide pin in response to the polarity of the electromagnet.

4. The connector device according to claim 3, wherein the lock/unlock means includes a contact portion made from at least one of a metal and a magnetic substance which can attract and hold the lock piece, the lock piece being arranged to contact the contact portion in one of a locked position and an unlocked position.

5. The connector device according to claim 4, wherein each of the lock piece and the guide pin has a contact surface, the contact surfaces of the lock piece and the guide pin being adapted to fit closely together.

6. The connector device according to claim 3, further comprising:

a light guide path disposed on one of the pair of connector housings, that is arranged to guide external incident light through the one of the pair of connector housings; and photo-electric converter means, disposed on the other of the pair of connector housings, for receiving the incident light guided by the light guide path, the photo-electric converter means being adapted to convert the incident light into electrical energy when the connector housings are engaged, and wherein the electromagnet is arranged to be driven by the electrical energy to advance and retract the lock piece.

7. A connector device comprising:

a pair of connector housings adapted to be engaged with each other and including signal connecting terminals adapted to transfer a signal; and lock/unlock means for locking and unlocking the connector housings in response to a signal provided to the connector housings, the lock/unlock means being mounted to at least one of the connector housings and including a transfer connection terminal adapted to transfer a control signal to operate the lock/unlock means, wherein the transfer connection terminal is connected to one of the signal connection terminals disposed in one of the connector housings to perform an external signal transfer.

8. A connector device comprising:

a pair of connector housings adapted to be engaged with each other, the connector housings including signal connecting terminals adapted to transfer a signal;

lock/unlock means for locking and unlocking the connector housings, the lock/unlock means being arranged to operate in response to a signal provided to the connector housings; and engaging state detecting means for detecting an engaging state of the connector housings, the engaging state detecting means being adapted to detect an engaging state based on a transmitting state of a light path between a light emitting section disposed on one of the pair of connector housings and a light receiving section disposed on the other of the pair of connector housings and to output a detection signal when the connector housings are placed into engagement with each other in a predetermined engaged state.

9. A connector device comprising:

a pair of connector housings adapted to be engaged with each other, the connector housings including signal connecting terminals adapted to transfer a signal;

lock/unlock means for locking and unlocking the connector housings, the lock/unlock means being adapted to operate in response to a signal provided to the connector housings; and locking state detecting means for detecting a locking state of the lock/unlock means, the locking state detecting means being adapted to output a detection signal.

10. The connector device according to claim 9, further comprising guide means for guiding the connector housings into engagement with each other, the guide means including a guide pin disposed on one of the connector housings and a guide bore disposed on the other of the connector housings, and wherein the lock/unlock means includes at least one retractable lock piece disposed in the guide bore, and the locking state detecting means is adapted to detect the locking state based on a conductive state of an electrical signal between electrodes respectively disposed on the lock piece and one of the connector housings.

11. The connector device according to claim 9, further comprising guide means for guiding the connector housings into engagement with each other, the guide means including a guide pin disposed on one of the connector housings and a guide bore disposed on the other of the connector housings, and wherein the lock/unlock means includes at least one retractable lock piece disposed in the guide bore, and the locking state detecting means is adapted to detect the locking state based on a conductive state of an electrical signal between electrodes respectively disposed on the lock piece and the guide pin.

12. The connector device according to claim 9, further comprising guide means for guiding the connector housings into engagement with each other, the guide means including a guide pin disposed on one of the connector housings and a guide bore disposed on the other of the connector housings, and wherein the lock/unlock means includes at least one retractable lock piece disposed in the guide bore, and the locking state detecting means is adapted to detect the locking state based on a transmitting state of a light path between a light emitting section and a light receiving section disposed adjacent the lock piece.

13. The connector device according to claim 9, further comprising guide means for guiding the connector housings into engagement with each other, the guide means including a guide pin disposed on one of the connector housings and a guide bore disposed on the other of the connector housings, and wherein the lock/unlock means includes at least one retractable lock piece disposed in the guide bore, and the locking state detecting means includes a magnetic field sensing type relay disposed in the guide pin and a magnetic substance disposed in the lock piece, the locking state detecting means being adapted to detect the locking state by driving the magnetic field sensing type relay to operate in response to a change in a magnetic field generated from a position of the lock piece relative to the relay.

14. The connector device according to claim 9, wherein the lock/unlock means includes a locking mechanism unit that is detachably mounted to one of the connector housings.

15. A connector device comprising:

a pair of connector housings adapted to be engaged with each other, the connector housings including signal connecting terminals adapted to transfer a signal;

lock/unlock means for locking and unlocking the connector housings in response to a signal provided to the connector housings; and guide means for guiding the connector housings into engagement with each other, the guide means including a guide pin and a guide bore, the guide pin being disposed on one of the connector housings, the guide bore being disposed on the other of the connector housings, and wherein the lock/unlock means is independent of the guide means.

16. The connector device according to claim 15, wherein the lock/unlock means includes:

a movable lock piece and a heat deformable member, each disposed in one of the pair of connector housings, the movable lock piece being attached to the heat deformable member and adapted to move when the heat deformable member changes shape, the heat deformable member being adapted to change shape in response to a temperature change;

heating means for heating the heat deformable member; and an engaging section disposed on the other of the pair of connector housings, the movable lock piece being adapted to engage the engaging section to lock the connector housings.

17. The connector device according to claim 16, further comprising:

a light guide path disposed on one of the pair of connector housings, the light guide path being adapted to guide external incident light through the one of the pair of connector housings; and photo-electric converter means for receiving the incident light guided by the light guide path, the photo-electric converter means being disposed on the other of the pair of connector housings and being adapted to convert the incident light into electrical energy, wherein the heating means is driven by the electrical energy to heat the heat deformable member so that the movable lock piece is moved to engage the engaging section.

* * * * *